US006380667B1

(12) United States Patent
Yokota et al.

(10) Patent No.: US 6,380,667 B1
(45) Date of Patent: Apr. 30, 2002

(54) COLOR CATHODE-RAY TUBE APPARATUS

(75) Inventors: Masahiro Yokota; Yuuichi Sano, both of Fukaya; Hiroaki Ibuki, Kumagaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/649,836

(22) Filed: Aug. 28, 2000

Related U.S. Application Data

(63) Continuation of application No. PCT/JP99/07414, filed on Dec. 28, 1999.

(30) Foreign Application Priority Data

Dec. 28, 1998 (JP) ..... 10-374216
Feb. 16, 1999 (JP) ..... 11-037114

(51) Int. Cl.[7] ..... H01J 29/76
(52) U.S. Cl. ..... 313/440; 313/431; 335/299
(58) Field of Search ..... 313/440, 429, 313/431, 433; 335/210, 213, 299, 296

(56) References Cited

U.S. PATENT DOCUMENTS 5,170,097 A * 12/1992 Giannantonio et al. . 313/440 X
5,880,660 A * 3/1999 Iwasaki et al. ..... 313/440 X
5,932,959 A * 8/1999 Shimada et al. ..... 313/440

FOREIGN PATENT DOCUMENTS

DE 4041895 * 7/1991 ..... 313/440
JP 60-170143 9/1985
JP 62-18888 1/1987
JP 6-48736 12/1994
JP 2522885 10/1996
WO WO00/39833 7/2000

OTHER PUBLICATIONS

Sluyterman, CRT4–2: The Philips Real Flat CRT Design, Proceedings of The Fourth International Display Workshops, pp. 413–416; Dec. 1998.

* cited by examiner

*Primary Examiner*—Ashok Patel
(74) *Attorney, Agent, or Firm*—Pillsbury Winthrop LLP

(57) ABSTRACT

A color cathode-ray tube having at least one trajectory correction device including a plurality of trajectory correction coils, and a current supply circuit for supplying current to these coils. The trajectory correction device functions to over-converge or under-converge a pair of side beams at a peripheral portion of the phosphor screen relative to a center of the phosphor screen. The trajectory correction device produces a magnetic field such that there is a position in the produced magnetic field where no force is exerted on the three electron beams. This position is separated from a plane including a tube axis, and a first direction or a second direction. In this color cathode-ray tube apparatus with this structure, no degradation occurs in focusing or distortion characteristics even where the trajectory correction device is provided, for example, in realizing a flat screen by using a press-formed shadow mask.

4 Claims, 14 Drawing Sheets

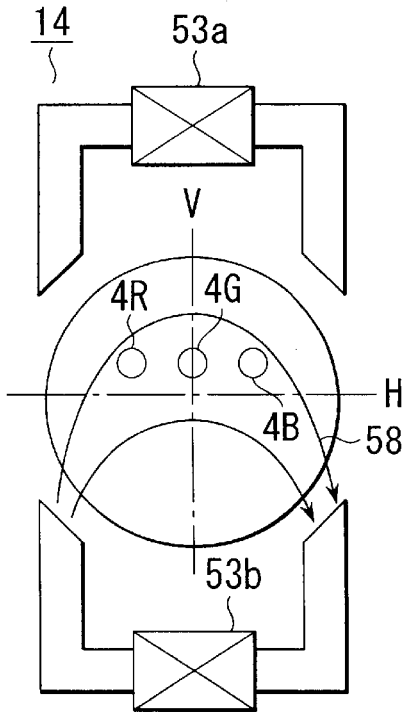
FIG. 20A
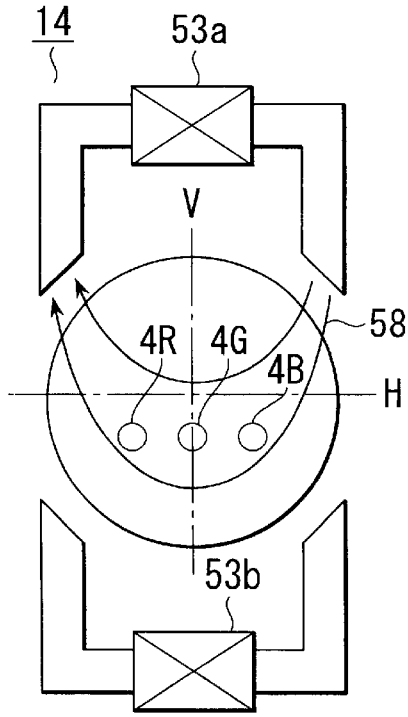
FIG. 20B
FIG. 21A
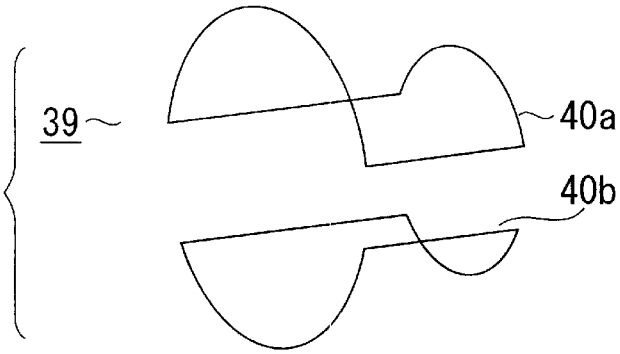
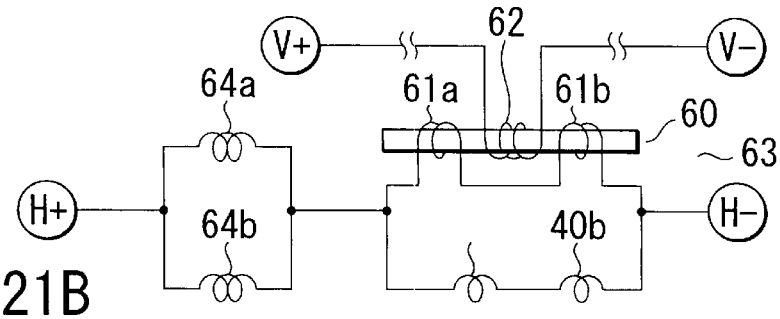
FIG. 21B

COLOR CATHODE-RAY TUBE APPARATUS

CROSS REFERENCE TO RELATED APPLICATIONS

This is a continuation of Application Ser. No. PCT/JP99/07414, filed Dec. 28, 1999.

This application is based upon and claims the benefit of priority from the prior Japanese Patent Applications No. 10-374216, filed Dec. 28, 1998; and No. 11-037114, filed Feb. 16, 1999.

BACKGROUND OF THE INVENTION

The present invention relates to a color cathoderay tube apparatus such as a TV Braun tube or a monitor Braun tube, and more particularly to a color cathoderay tube apparatus in which no degradation occurs in focusing or distortion characteristics even where an electron beam trajectory correction means with a high degree of magnetic field distribution displacement is provided in realizing a flat screen by incorporation of a press-formed shadow mask.

In general, a color cathode-ray tube apparatus has a vacuum envelope comprising a panel with a substantially rectangular display section, a funnel formed to be continuous with the panel, and a cylindrical neck formed to be continuous with a small-diameter end portion of the funnel. A deflection yoke is mounted on a region extending from a funnel-side portion of the neck to a small-diameter portion of the funnel. An inner face of the panel is provided with a phosphor screen having dot-like or striped three-color phosphor layers which emit blue, green and red. A shadow mask is disposed to be opposed to the phosphor screen, at a distance from the phosphor screen. That surface of the shadow mask, which is opposed to the phosphor screen, has a great number of electron beam passage holes arranged with a predetermined pitch. The shadow mask has a so-called color selection function for guiding electron beams to the associated phosphor layers of the phosphor screen. The neck includes an electron gun apparatus for emitting three electron beams. The electron beams emitted from the electron gun apparatus are deflected horizontally and vertically by horizontal and vertical deflection magnetic fields produced by the deflection yoke, and the electron beams are directed to the phosphor screen through the shadow mask. The electron beams horizontally and vertically scan the phosphor screen and thus this screen displays a color image.

This kind of modern color cathode-ray tube apparatus is, in general, of an in-line type wherein three in-line electron beams comprising a center beam and a pair of side beams, which travel in the same plane, are emitted from the electron gun apparatus. In addition, most of practically used color cathode-ray tube apparatuses are of a self-convergence type wherein the horizontal deflection magnetic field produced by the deflection yoke has a pincushion shape and the vertical deflection magnetic field has a barrel shape, and the three in-line electron beams are deflected by the horizontal and vertical deflection magnetic fields, whereby the three electron beams can be converged over the entire screen without using a special convergence correction means.

Recently, there is a strong demand for flatness of the screen in this type of color cathode-ray tube apparatus. If the panel is flattened in order to realize the flatness of the screen, it is necessary to flatten the shadow mask, too. As a result, the following problem will arise.

In general, in the color cathode-ray tube apparatus, the three electron beams are converged at the center of the phosphor screen, mainly by a purity convergence magnet attached to the neck-side portion of the deflection yoke. The three electron beams pass through the electron beam passage holes in the shadow mask at predetermined angles, respectively, and land on the associated phosphor layers. In order to obtain a proper landing tolerance for the phosphor layers, it is required to properly set the distance between the inner face of the panel and the shadow mask.

Assume that, as shown in FIG. 1, a distance in a tube axis direction between a purity convergence magnet 1 and a shadow mask 2 is L (the distance L at the center of the phosphor screen is Lo), a distance in the tube axis direction between the shadow mask 2 and the inner face of a panel 3 is q (the distance q at the center of the phosphor screen is qO), a distance between a center beam 4G and each of paired side beams 4R, 4B in a direction of arrangement of the three electron beams is Sg (the distance Sg at the position of the purity convergence magnet is Sg0), a distance between the center beam 4G and the side beam 4B, 4R is σ, and a pitch of the landing position of the center beam 4G on the inner face of the panel 3 in the direction of arrangement of three electron beams is Ph (the pitch Ph at the center of the phosphor screen is Ph0). Since $$q=L\times\sigma/Sg$$

$$\sigma=Ph/3$$

the following equation (1) is established:

$$q=L\times Ph/(3\times g) \quad (1)$$

Normally, the distance L and distance Sg are substantially constant over the entire area of the phosphor screen, and the pitch Ph, too, is basically constant. Accordingly, if the panel is flattened, it is necessary to flatten the shadow mask, too.

However, the shadow mask, in general, is manufactured by forming a flat, thin-plate-like shadow mask material, in which electron beam passage holes have been formed by photoetching, so as to have a predetermined curved surface. Using a forming apparatus as shown in FIG. 2, the shadow mask is formed to have a predetermined shape. Specifically, in the forming apparatus shown in FIG. 2, a non-hole portion 7 surrounding a region 6 with electron beam passage holes is clamped and fixed between a die 8 and a blank holder 9. The region 6 with electron beam passage holes is extended and formed in a predetermined shape by a punch 10 and a knockout 11. If the shadow mask is flattened and the amount of extension is reduced, plastic deformation cannot adequately be effected. The predetermined curved surface cannot be obtained due to degradation in workability. In addition, the strength of the formed shadow mask deteriorates and the shadow mask tends to be easily deformed.

FIGS. 3 and 4 show techniques for solving the above problems. In the techniques, trajectory correction means 14 and 15 for correcting the trajectories of the side beams 4R and 4B are provided between a cathode K of the electron gun apparatus, which emits three in-line electron beams 4R, 4G and 4B, and a phosphor screen 13. The trajectory correction means 14 and 15 exert force to the pair of side beams 4R and 4B, thereby to correct and turn the trajectories of the side beams 14 and 15 toward the center beam 4G. This force is made different between a central area and a peripheral area of the phosphor screen 13. More specifically, this force is varied in the following manner. That is, an imaginary distance Sg between the center beam 4G and the side beam 4R, 4B in the direction of arrangement of the three electron beams at the central area and peripheral area of the phosphor screen 13 is determined such that the distance Sg toward the peripheral portion of the phosphor screen 13 may be smaller than the distance Sg toward the center of the phosphor screen 13.

In the structure shown in FIG. 3, forces FrO and FfO produced by the two trajectory correction means 14 and 15 are set at zero at the center of the phosphor screen 13. In the peripheral region of the phosphor screen 13, the side beam 4B, 4R is over-converged by the force Fr1 produced by the neck-side trajectory correction means 14 and the side beam 4B, 4R is under-converged by the force Ff1 produced by the phosphor-screen-side trajectory correction means 15. Thereby, the imaginary distance Sg at the cathode K decreases from a distance Sgc0 to a distance Sgc1 from the center toward the periphery of the phosphor screen 13. Thus, the distance q in the tube axis direction between the inner face of the panel 3 and the shadow mask 2 at the peripheral region of the phosphor screen 13 is increased by a degree given below, relative to a distance q0 in the tube axis direction between the inner face of the panel 3 and the shadow mask 2 at the central region of the phosphor screen 13:

$$\Delta q = q - q0$$

Assume, in this case, that a distance in the tube axis direction between the phosphor screen-side trajectory correction means 15 and the phosphor screen 13 is Lf, a distance in the tube axis direction between the two trajectory correction means 14 and 15 is ΔL, a distance Sg at the neck-side trajectory correction means 14 is Sgr0, and an over-convergence amount of the neck-side trajectory correction means 14 is CV1. The following equation (2) is established:

$$\Delta q = q0 \times \Delta L \times CV1 / (2 \times Lf \times Sgr0 - \Delta L \times CV1) \quad (2)$$

In the structure shown in FIG. 4, forces Fr1 and Ff1 produced by the two trajectory correction means 14 and 15 are set at zero at the peripheral region of the phosphor screen 13. At the central of the phosphor screen 13, the side beam 4B, 4R is under-converged by the force Ff0 produced by the neck-side trajectory correction means 14 and the side beam 4B, 4R is over-converged by the force Ff0 produced by the phosphor screen-side trajectory correction means 15. Thereby, the imaginary distance Sg at the cathode K increases from a distance Sgc1 to a distance Sgc0 from the periphery toward the center of the phosphor screen 13. Thus, Δq can be increased.

However, if the trajectory correction means 14 and 15 for over-/under-converging the paired side beams 4B and 4R in accordance with the position on the phosphor screen are provided, as described above, the degree of degradation in focusing characteristics or distortion characteristics increases as the amount of trajectory correction increases.

As has been mentioned above, in the color cathode-ray tube apparatus, if the panel is flattened, it is necessary to flatten the shadow mask, too, and the predetermined curved surface cannot be obtained due to degradation in workability. In addition, the strength of the formed shadow mask deteriorates and the shadow mask tends to be easily deformed.

To solve the problems, there is the technique wherein two trajectory correction means are provided between the cathode of the electron gun for emitting three in-line electron beams and the phosphor screen. The force produced by the trajectory correction means for correcting and turning the trajectories of the paired side beams toward the center beam is varied between the center portion and peripheral portion of the phosphor screen. The imaginary distance Sg between the center beam and the side beam in the direction of arrangement of the three electron beams at the central area and peripheral area of the phosphor screen is determined such that the distance Sg toward the peripheral area may be smaller than the distance Sg toward the center of the phosphor screen.

However, if the trajectory correction means for over-/under-converging the paired side beams in accordance with the position on the phosphor screen are provided, the problem arises in that the degree of degradation in focusing characteristics or distortion characteristics increases as the amount of trajectory correction increases.

BRIEF SUMMARY OF THE INVENTION

The object of the present invention is to provide a color cathode-ray tube apparatus in which no degradation occurs in focusing or distortion characteristics even where electron beam trajectory correction means with a high degree of magnetic field distribution displacement is provided, for example, in realizing a flat screen by using a press-formed shadow mask.

According to the present invention, there is provided a color cathode-ray tube apparatus comprising:

- a vacuum envelope composed of a substantially rectangular panel, a funnel formed to be continuous with the panel and having a small-diameter end portion, and a neck formed to be continuous with the small-diameter end portion of the funnel;
- a phosphor screen having phosphor layers provided on an inner surface of the panel;
- a shadow mask having a surface opposed to the phosphor screen at a distance from the phosphor screen, the surface having a great number of electron beam passage holes;
- an electron gun apparatus provided within the neck and having a cathode and a plurality of electrodes for emitting three in-line electron beams consisting of a center beam and a pair of side beams traveling in the same plane;
- a deflection yoke mounted on a region extending from a funnel-side portion of the neck to a small-diameter portion of the funnel, the deflection yoke deflecting the three electron beams in a first direction, which is a direction of arrangement of the three electron beams, and in a second direction perpendicular to the first direction; and
- trajectory correction means for correcting trajectories of the side beams, the trajectory correction means including a plurality of trajectory correction coils disposed between the cathode of the electron gun apparatus and the phosphor screen and a current supply circuit for supplying to the trajectory correction coils a current synchronized with deflection of the first direction and/or the second direction, at least one of the trajectory correction means functioning to relatively over-converge or / under-converge the pair of side beams at a peripheral portion of the phosphor screen relative to a center of the phosphor screen, there is a position in a magnetic field produced in a region of passage of the three electron beams, where no force is exerted on the three electron beams in the first direction and/or the second direction, and a magnetic field being produced to separate this position from a plane including a tube axis, the first direction and/or the second direction.

According to the present invention, there is also provided a color cathode-ray tube apparatus comprising:

a vacuum envelope composed of a substantially rectangular panel, a funnel formed to be continuous with the panel and having a small-diameter end portion, and a neck formed to be continuous with the small diameter end portion of the funnel;

a phosphor screen provided on an inner surface of the panel;

a shadow mask having a surface opposed to the phosphor screen at a distance from the phosphor screen, the surface having a great number of electron beam passage holes;

an electron gun apparatus provided within the neck and having a cathode and a plurality of electrodes for emitting three in-line electron beams consisting of a center beam and a pair of side beams traveling in the same plane;

a deflection yoke mounted on a region extending from a funnel-side portion of the neck to a small-diameter portion of the funnel, the deflection yoke deflecting the three electron beams in a first direction, which is a direction of arrangement of the three electron beams, and in a second direction perpendicular to the first direction;

trajectory correction means for correcting trajectories of the side beams, the trajectory correction means including a plurality of trajectory correction coils disposed between the cathode of the electron gun apparatus and the phosphor screen and a current supply circuit for supplying to the trajectory correction coils a current synchronized with deflection of the first direction or the second direction, the trajectory correction means functioning to relatively over-converge or under-converge the side beams at a peripheral portion of the phosphor screen relative to a center of the phosphor screen; and at least one auxiliary deflection means comprising a plurality of auxiliary deflection coils disposed between the cathode of the electron gun apparatus and the phosphor screen and a current supply circuit for supplying to the auxiliary deflection coils a current synchronized with deflection of the first direction and/or the second direction, the auxiliary deflection means effecting auxiliary deflection for the three electron beams at the peripheral portion of the phosphor screen in a direction opposite to the direction of deflection of the deflection yoke.

According to the present invention, there is also provided a color cathode-ray tube apparatus comprising:

a vacuum envelope composed of a substantially rectangular panel, a funnel formed to be continuous with the panel and having a small-diameter end portion, and a neck formed to be continuous with the small-diameter end portion of the funnel;

a phosphor screen provided on an inner surface of the panel;

a shadow mask having a surface opposed to the phosphor screen at a distance from the phosphor screen, the surface having a great number of electron beam passage holes;

an electron gun apparatus provided within the neck and having a cathode and a plurality of electrodes for emitting three in-line electron beams consisting of a center beam and a pair of side beams traveling in the same plane;

a deflection yoke mounted on a region extending from a funnel-side portion of the neck to a small-diameter portion of the funnel, the deflection yoke deflecting the three electron beams in a first direction, which is a direction of arrangement of the three electron beams, and in a second direction perpendicular to the first direction;

at least one trajectory correction means including a plurality of trajectory correction coils disposed between the cathode of the electron gun and the phosphor screen and a current supply circuit for supplying to the trajectory correction coils a current synchronized with deflection of at least the second direction, the trajectory correction means functioning to relatively over-converge or under-converge the pair of side beams at a peripheral portion of the phosphor screen relative to a center of the phosphor screen; and auxiliary deflection means comprising a plurality of auxiliary deflection coils disposed between the cathode of the electron gun and the phosphor screen and a current supply circuit for supplying to the auxiliary deflection coils a current synchronized with deflection of the first direction and synchronized with deflection of the second direction and modulated, the auxiliary deflection means effecting auxiliary deflection for the three electron beams at the peripheral portion of the phosphor screen in the first direction.

According to the present invention, there is also provided a color cathode-ray tube apparatus comprising:

a vacuum envelope composed of a substantially rectangular panel, a funnel formed to be continuous with the panel and having a small-diameter end portion, and a neck formed to be continuous with the small-diameter end portion of the funnel;

a phosphor screen provided on an inner surface of the panel;

a shadow mask having a surface opposed to the phosphor screen at a distance from the phosphor screen, the surface having a great number of electron beam passage holes;

an electron gun apparatus provided within the neck and having a cathode and a plurality of electrodes for emitting three in-line electron beams consisting of a center beam and a pair of side beams traveling in the same plane;

a deflection yoke mounted on a region extending from a funnel-side portion of the neck to a small-diameter portion of the funnel, the deflection yoke deflecting the three electron beams in a first direction, which is a direction of arrangement of the three electron beams, and in a second direction perpendicular to the first direction;

at least one trajectory correction means including a plurality of trajectory correction coils disposed between the cathode of the electron gun and the phosphor screen and a current supply circuit for supplying to the trajectory correction coils a current synchronized with deflection of at least the first direction, the trajectory correction means functioning to relatively over-converge or under-converge the pair of side beams at a peripheral portion of the phosphor screen relative to a center of the phosphor screen; and auxiliary deflection means comprising a plurality of auxiliary deflection coils disposed between the cathode of the electron gun and the phosphor screen and a current supply circuit for supplying to the auxiliary deflection coils a current synchronized with deflection of the second direction and synchronized with deflection of the first direction and modulated, the auxiliary deflection means effecting auxiliary deflection for the three electron beams at the peripheral portion of the phosphor screen in the second direction.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 20A and 20B are views for describing the operations for solving problems of focusing characteristics of the color cathode-ray tube apparatus shown in FIG. 16;

FIG. 21A is a view for schematically showing the structures of auxiliary deflection coils provided in a color cathode-ray tube apparatus according to a second embodiment of the present invention;

FIG. 21B is a circuit diagram showing a current supply circuit for supplying current to the coils shown in FIG. 21A;

DETAILED DESCRIPTION OF THE INVENTION

Color cathode-ray tube apparatuses according to embodiments of the present invention will now be described with reference to the accompanying drawings.

Figure 1:
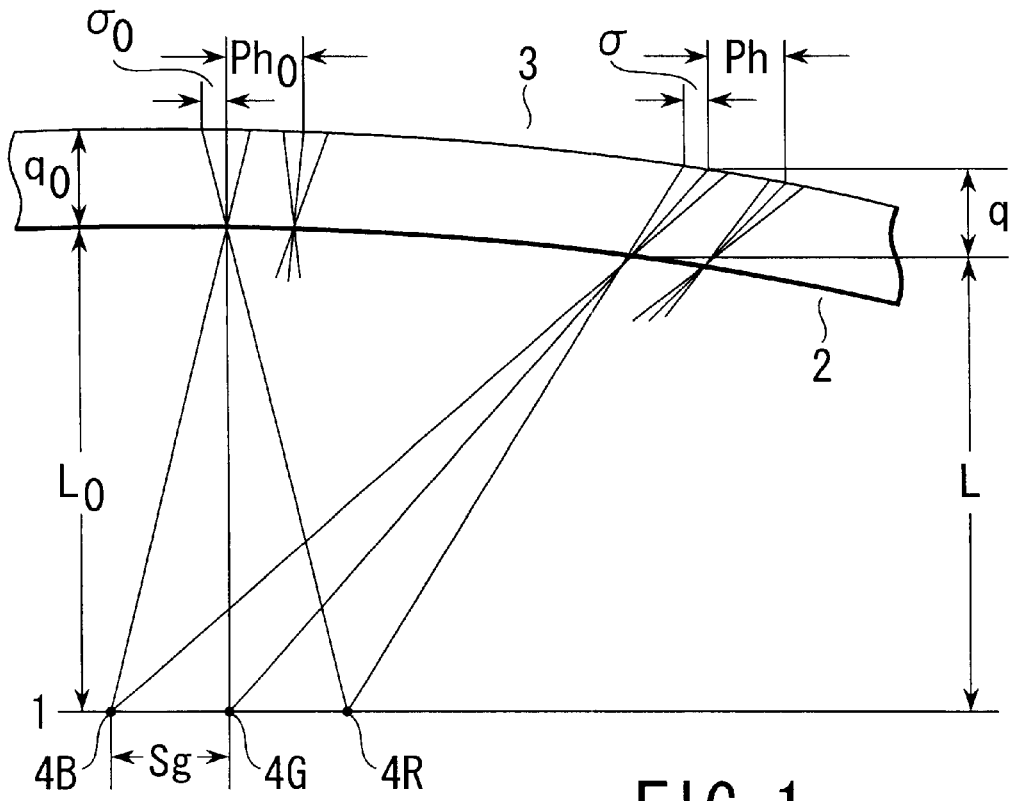
FIG. 1 is a schematic cross-sectional view for describing the relationship between a panel and a shadow mask of a conventional color cathode-ray tube apparatus.
Figure 2:
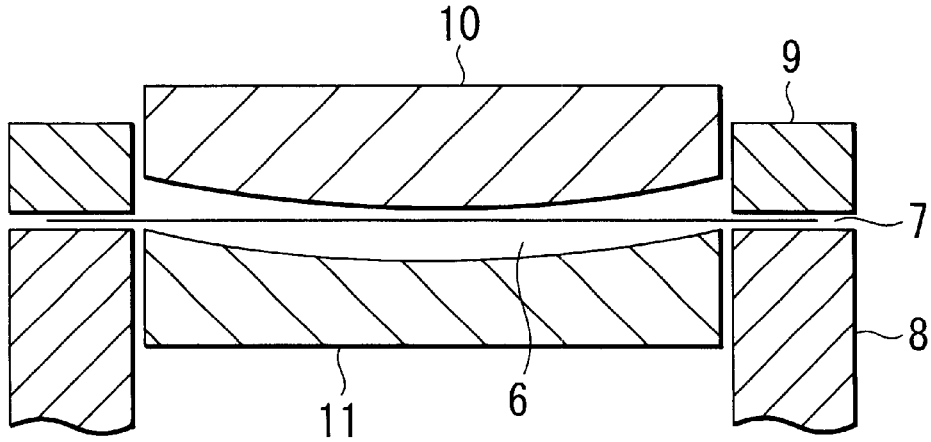
FIG. 2 is a schematic cross-sectional view of a forming apparatus, for describing a method of forming the shadow mask shown in FIG. 1.
Figure 3:
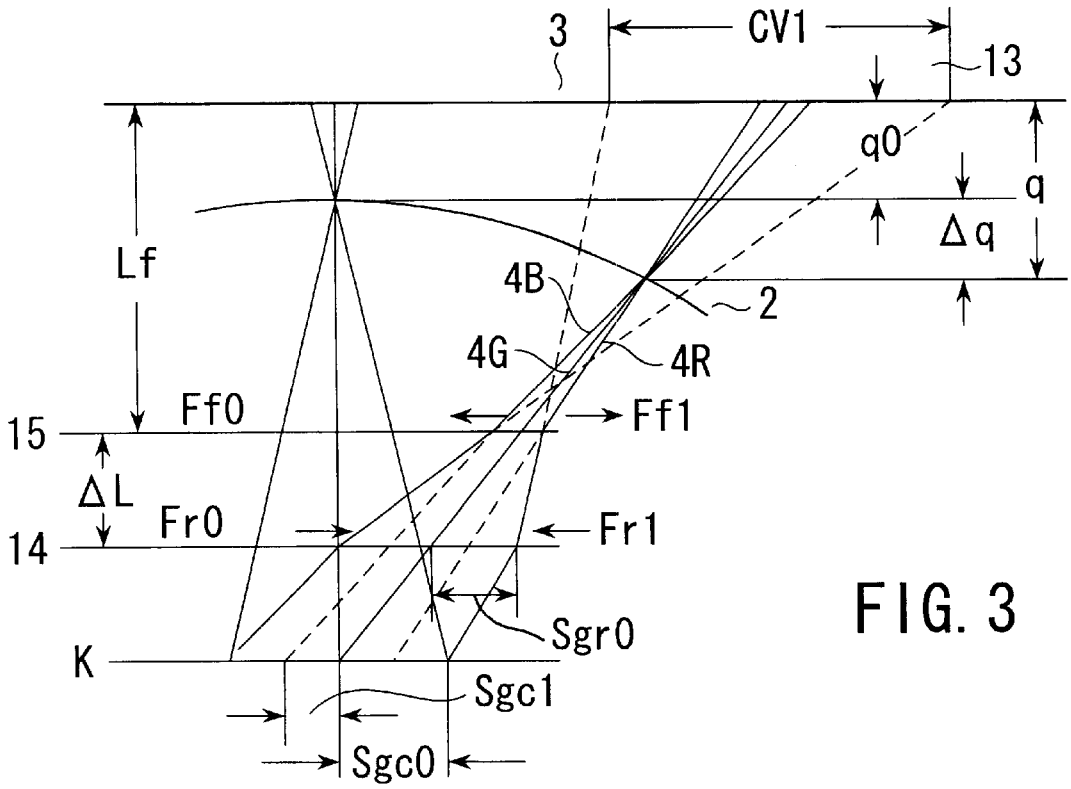
FIG. 3 is a schematic view for explaining a principle of means for enlarging a distance between the panel and shadow mask at a peripheral portion of a phosphor screen.
Figure 4:
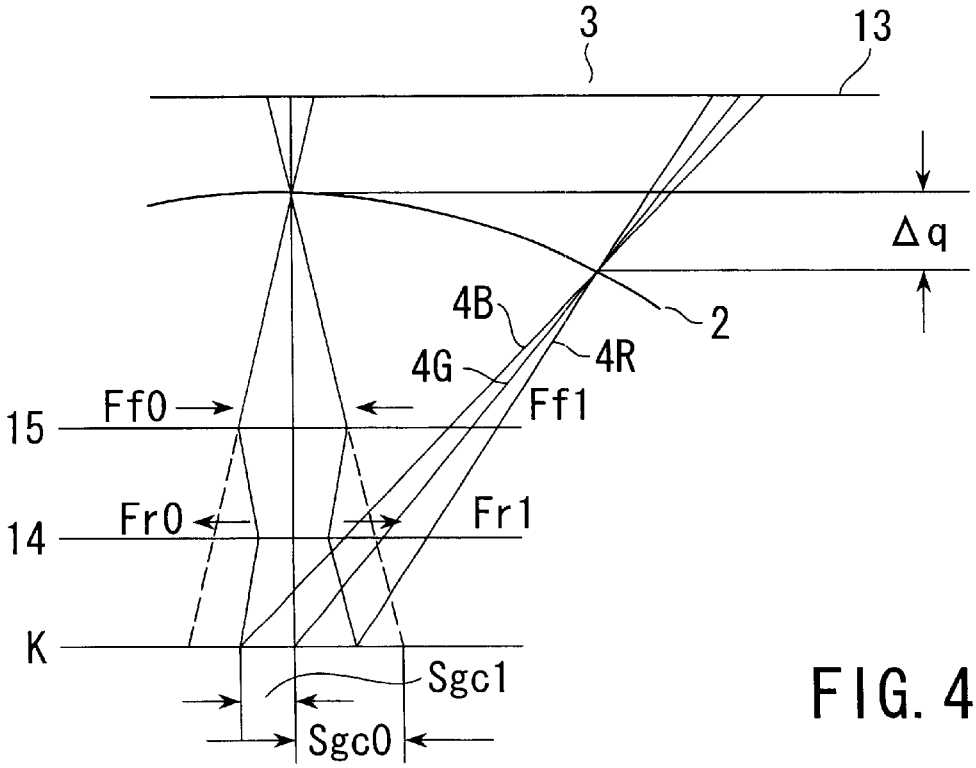
FIG. 4 is a schematic view for explaining a principle of another means for enlarging a distance between the panel and shadow mask at a peripheral portion of a phosphor screen.

The present invention is based on results of analysis of problems of focusing and distortion, which arise when the two trajectory correction means as described with reference to FIG. 3 are provided.

Figure 5:
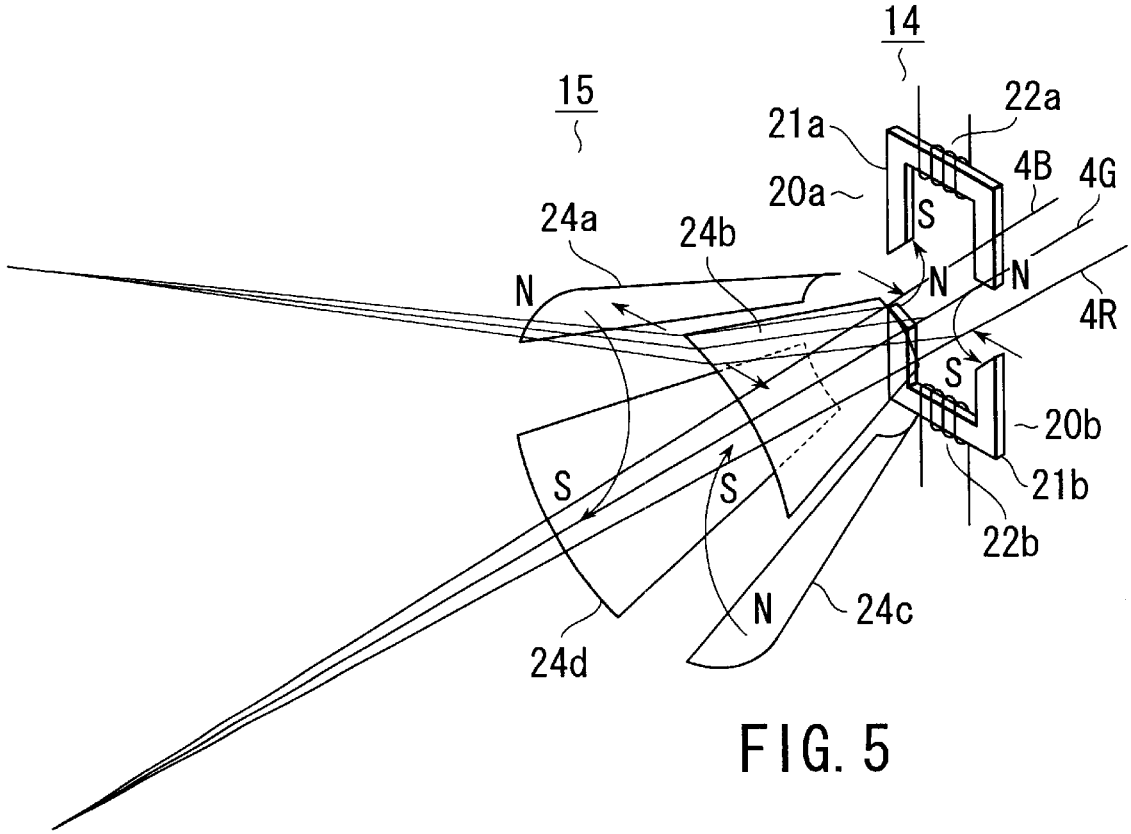
FIG. 5 shows structures of two trajectory correction means provided on a deflection yoke of a color cathode-ray tube apparatus.

FIG. 5 shows a specific example of the two trajectory correction means. The trajectory correction means shown in FIG. 5 are additionally provided on the deflection yoke mounted on an outside of a portion extending from the funnel-side portion of the neck to the small-diameter portion of the funnel, in an in-line color cathode-ray tube apparatus which emits three in-line electron beams consisting of a center beam and a pair of side beams traveling in the same horizontal plane.

The two trajectory correction means 14, 15 comprise two trajectory correction coils 22*a*, 22*b* serving as neck-side trajectory correction means 14, which are wound around two U-shaped magnetic cores 21*a*, 21*b* of coma-free coils 20*a*, 20*b* provided on the neck-side portion of the deflection yoke (not shown); four trajectory correction coils 24*a*, 24*b*, 24*c*, 24*d* serving as phosphor-screen-side trajectory correction means 15, which are wound around bobbins (not shown) supporting vertical deflection coils 23*a*, 23*b*; and a current supply circuit 25 for supplying current to the trajectory correction coils 22*a*, 22b, 24*a*, 24*b*, 24*c* and 24*d*.

The trajectory correction coils 22*a*, 22*b*, 24*a*, 24*b*, 24*c* and 24*d* are connected to a diode rectifier circuit 26 which is connected to the vertical deflection coils 23*a*, 23*b* via the coma-free coils 20*a*, 20*b*. Where the electron beams 4B, 4G and 4R are deflected, the current supply circuit 25 is set to supply zero-level current when the electron beams 4B, 4G and 4R are directed to the horizontal axis of the phosphor screen, and to supply current of the same direction when the electron beams 4B, 4G and 4R are directed to upper and lower portions of the phosphor screen.

The two trajectory correction coils 22*a*, 22*b* of the neck-side trajectory correction means 14 are wound such that when power is supplied the polarities of the magnetic poles formed at end portions of the magnetic cores 21*a*, 21*b* are reversed at adjacent quadrants. Quadrupole magnetic field components are thus produced to over-converge the paired side beams 4B, 4R. On the other hand, the two trajectory correction coils 24*a*, 24*b*, 24*c*, 24*d* of the phosphor-screen-side trajectory correction means 15 are wound such that when power is supplied the directions of magnetic fields produced among adjacent trajectory correction coils 24*a*, 24*b*, 24*c*, 24*d* are reversed. Quadrupole magnetic field components are thus produced to under-converge the paired side beams 4B, 4R.

As has been described with reference to FIG. 3, if the trajectory correction means 14, 15 are provided, the imaginary distance S decreases and the distance q increases at the upper and lower ends of the phosphor screen.

Specifically, in the case of a high-resolution color cathode-ray tube apparatus wherein the effective diagonal dimension of the phosphor screen is 460 mm and the deflection angle is 90°, q0=9 mm Lf=270 mm ΔL=50 mm Sgr0=5 mm Assume from the equation (2) that the amount CV1 of over-convergence by the neck-side trajectory correction means 14 at the upper and lower ends of the phosphor screen is CV1=20 mm.

In this case, the distance q can be increased by 5 mm at the upper and lower ends of the phosphor screen.

However, if the trajectory correction means 14, 15 is provided, the focusing and distortion deteriorate.

To begin with, the analysis of degradation of focusing characteristics and the countermeasure according to an embodiment of the present invention will be described.

The function of the trajectory correction means 14, 15 shown in FIG. 3 is equivalent to the changing of lens magnification in the direction of arrangement of three electron beams. Basically, the focusing characteristics in the direction of arrangement of three electron beams are varied by the presence/absence of trajectory correction. In fact, however, it has turned out that the change in focusing characteristics due to deviation of electron beams from the tube axis by deflection is an important factor, aside from main factor of the change of lens magnification.

Figure 7A:
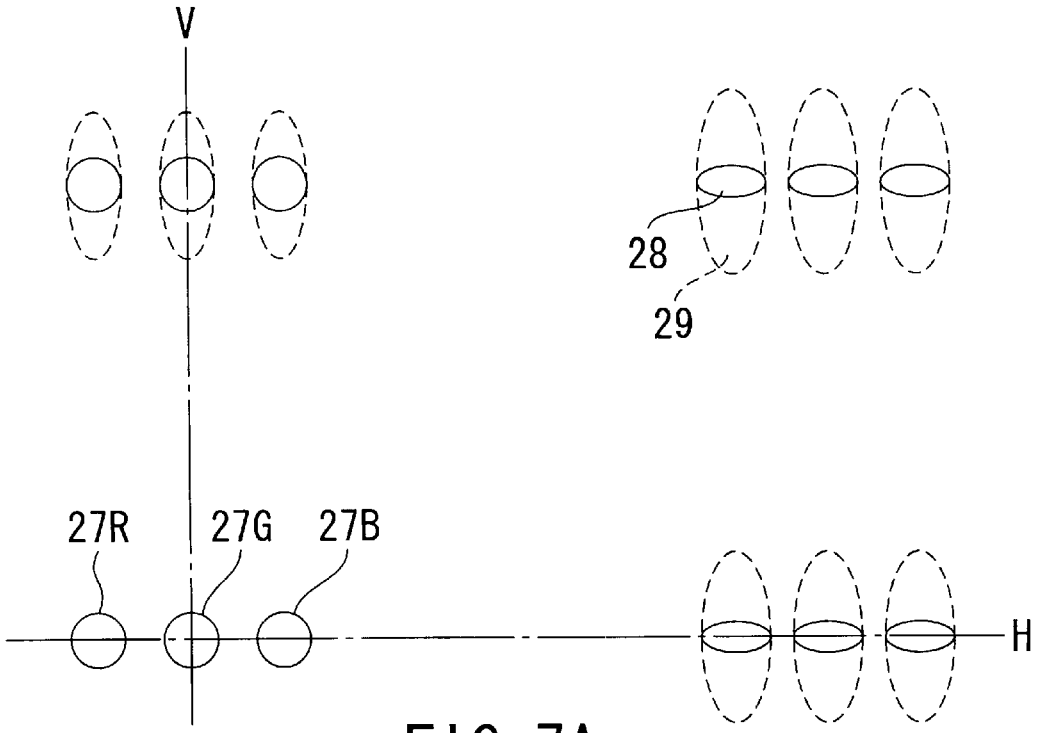
FIG. 7A is a plan view for explaining degradation in focusing characteristics of a color cathode-ray tube apparatus having no trajectory correction means.
Figure 7B:
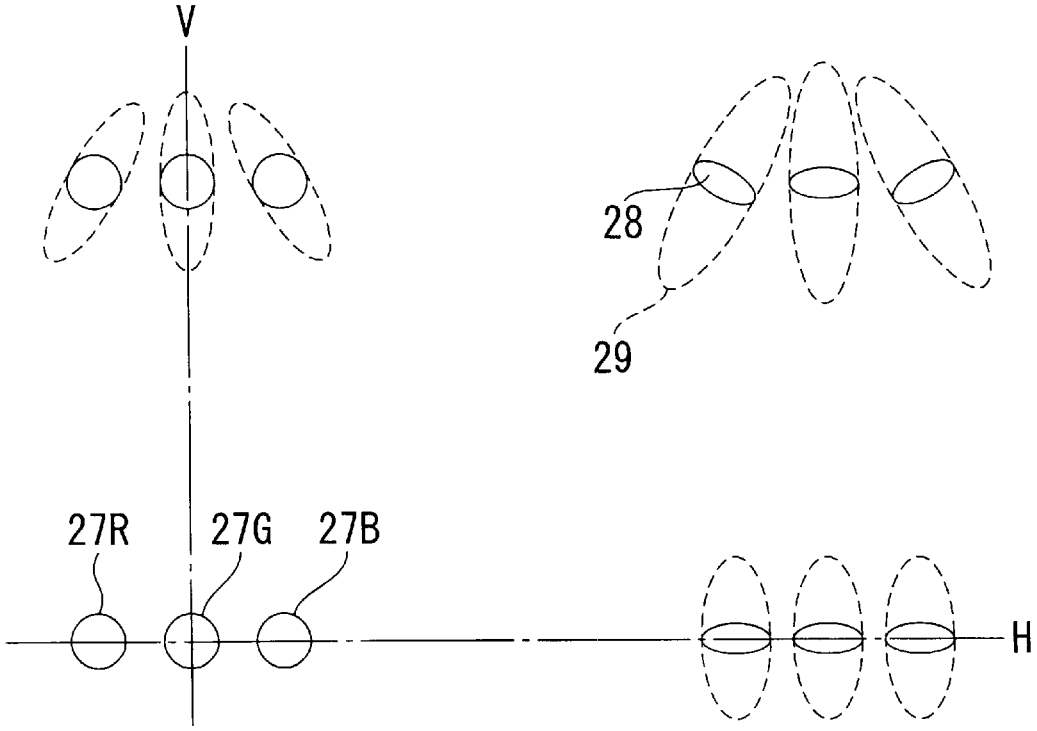
FIG. 7B is a plan view for explaining degradation in focusing characteristics of a color cathode-ray tube apparatus having trajectory correction means.

FIGS. 7A and 7B show focusing characteristics of the three electron beams in the first quadrant of the phosphor screen. FIG. 7A shows a case where no trajectory correction means is provided, and FIG. 7B shows a case where trajectory correction means is provided. The electron gun has a spatial extension. The beam size at an electron lens section of the electron gun is about 2 mm, and the central portion thereof which has a diameter of 0.1 to 0.5 mm has a large electron density. A beam spot 27R, 27G, 27R on the phosphor screen has such a shape that a high-luminance core portion 28 indicated by a solid line is surrounded by a low-luminance halo portion 29 indicated by a broken line.

Normally, where the trajectory correction means is not provided, the color cathode-ray tube apparatus has such a spherical aberration as to reduce the lens magnification as the electron beam deviates from the axis. Thus, as shown in FIG. 7A, at the center of the phosphor screen, optimal setting is effected so that the under-focused core portion 28 may overlap the over-focused halo portion 29 with substantially the same size. At this time, at the peripheral portion of the phosphor screen, like the center of the phosphor screen, the core portion 28/halo portion 29 is set in the optimal state in the horizontal direction (H-axis direction) by over-focusing due to an increase in optical path length and horizontal under-focusing and vertical over-focusing due to the pincushion type horizontal deflection magnetic field and barrel-type vertical deflection magnetic field, and the halo portion 29 is over-focused in the vertical direction (V-axis direction).

The vertical over-focusing at the peripheral portion of the phosphor screen can be improved by forming a correction lens for effecting vertical under-focusing, by applying to a predetermined electrode of the electron gun a variable voltage increasing in synchronism with deflection.

However, as mentioned above, if the trajectory correction means with a strong over-/under-convergence correction function is provided, the halo portion 29 has an inverted V-shape (over-focused state) at the upper and lower ends of the phosphor screen, as shown in FIG. 7B. Even if correction is made by the variable voltage, a blur remains in the horizontal direction and the focusing deteriorates.

Figure 8A:
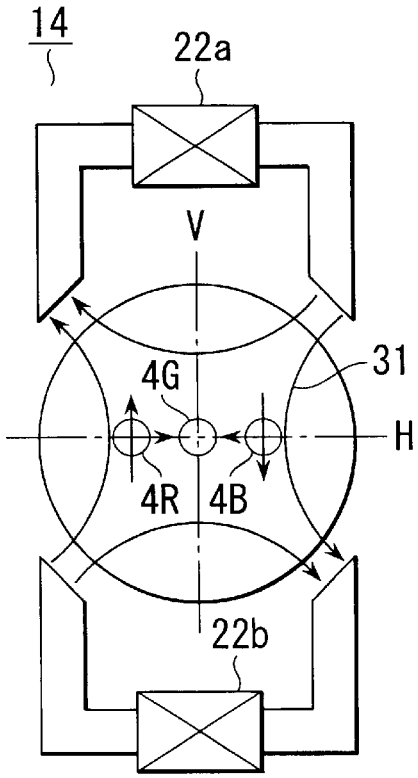
FIGS. 8A to 8D are a schematic front view and plan views for explaining the effect exerted by the trajectory correction means upon a pair of side beams.
Figure 8B:
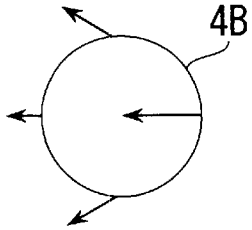
Figure 8C:
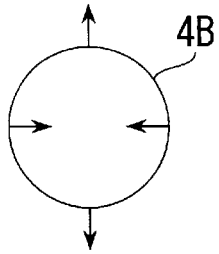
Figure 8D:
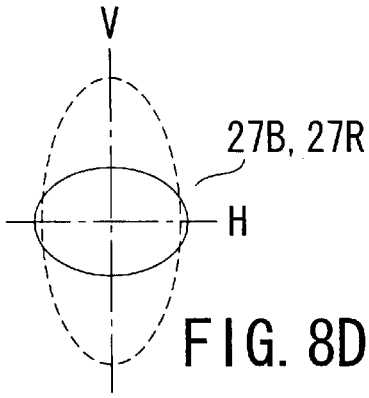

As is shown in FIG. 8A, a magnetic field 31 produced by the neck-side trajectory correction means 14 is a quadrupole magnetic field. The force of the magnetic field 31 acts on the paired side beams 4B, 4R, as indicated by arrows in FIG. 8B which shows one side beam 4B. This force is equivalent to the force indicated by arrows in FIG. 8C. As is shown in FIG. 8D, the beam spot 27B, 27R of each of paired side beams 4B, 4R is horizontally over-focused and vertically under-focused at the vertical axis end of the phosphor screen. Such focusing characteristics can be improved by applying a variable voltage to a predetermined electrode of the electron gun.

In fact, however, at the trajectory correction coils 22*a*, 22*b* serving as the neck-side trajectory correction means 14 provided on the neck-side portion of the deflection yoke, the electron beams 4B, 4G, 4R are slightly deflected due to a leak magnetic field from the deflection yoke and magnetic fields of the coma-free coils. Consequently, the three electron beams 4B, 4G, 4R pass through positions deviating from the tube axis in a direction corresponding to the deflection.

Figure 9A:
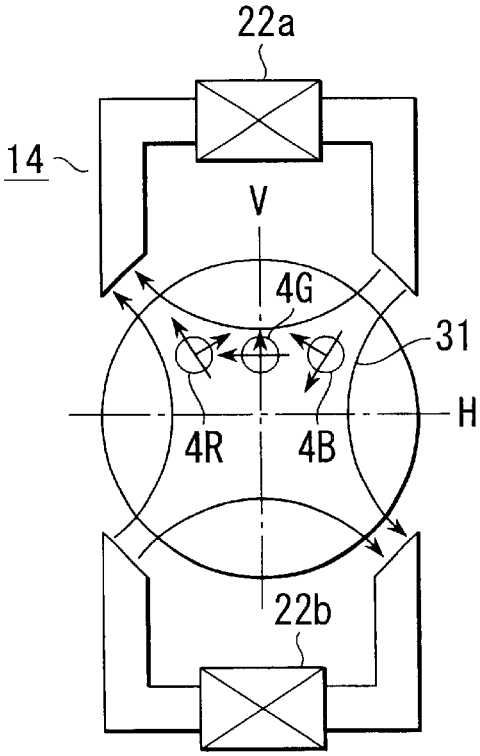
FIGS. 9A to 9D are a schematic front view and plan views for explaining the effect exerted by the trajectory correction means upon a pair of side beams, when electron beams are deflected by deflection coils.
Figure 9B:
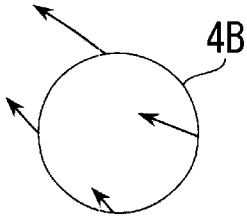
Figure 9C:
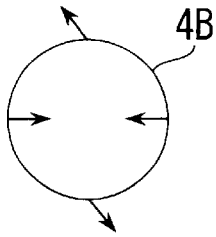
Figure 9D:
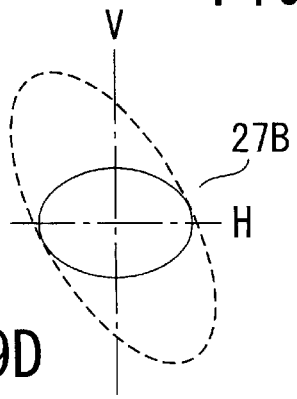

FIGS. 9A to 9D illustrate, in association with FIGS. 8A to 8D, the effect on focusing where beams travel with deviation through a horizontal upper region of the magnetic field 31 of the neck-side trajectory correction means 14 due to the leak magnetic field from the deflection yoke and magnetic fields of the comafree coils. In this case, the three electron beams 4B, 4G, 4R receive a vertical force which is not normally exerted. In particular, as one side beam 4B has been described with reference to FIGS. 8B and 8C, the paired side beams 4B, 4R receive forces of different directions according to their positions. As a result, the beam spot of the side beam 4B, 4R is twisted, as shown in FIG. 9D which shows the beam spot 27B. Consequently, the inverted V-shaped over-focusing, as shown in FIG. 7B, occurs.

Figure 10A:
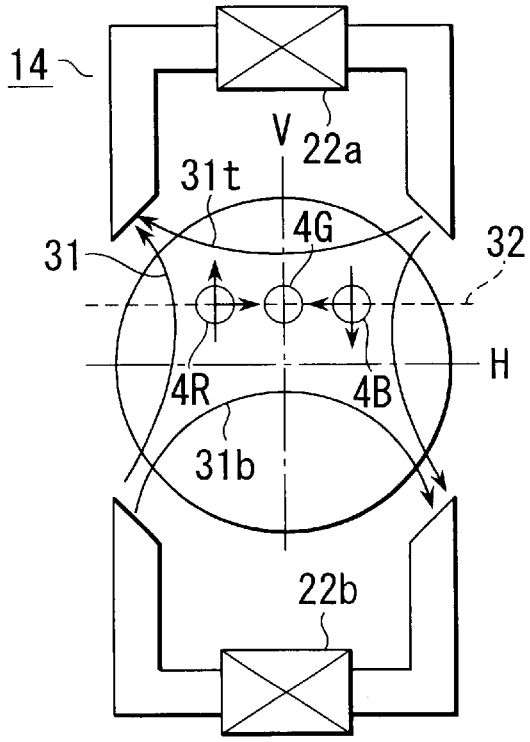
FIGS. 10A and 10B are views illustrating a basic principle of the present invention for solving problems of the degradation in focusing characteristics.
Figure 10B:
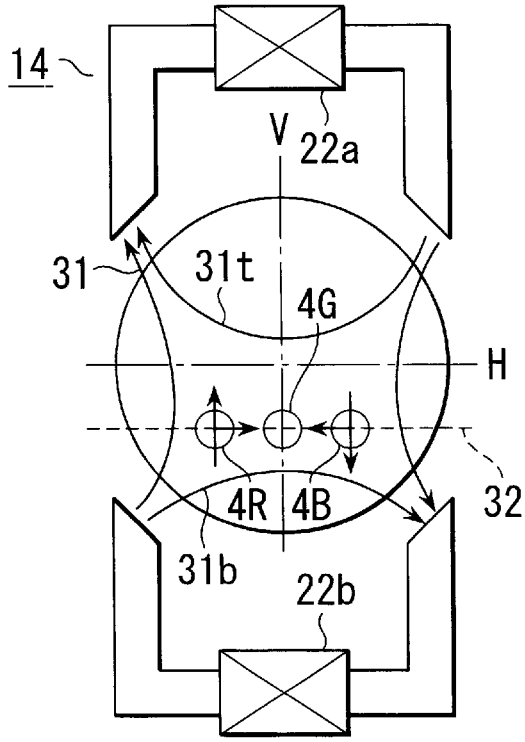

FIGS. 10A and 10B are views for explaining the basic principle of the embodiment of the invention for suppressing the degradation in the focusing. The degradation in the focusing characteristics occurs because the positions of passage of the three electron beams are deviated by the neck-side trajectory correction means in a vertical direction which is perpendicular to the direction of arrangement of the three electron beams. In the embodiment of the present invention, the magnetic field 31 produced by the two trajectory correction coils of the neck-side trajectory correction means 14 is varied such that when the beams are deflected toward the upper end of the phosphor screen the intensity of a magnetic field 31*t* produced by the upper coil 22*a* is made less than that of a magnetic field 31*b* produced by the lower coil 22*b*, as shown in FIG. 10A, that is,

31*t*<31*b*.

On the other hand, where the beams are deflected toward the lower end of the phosphor screen, the intensities of magnetic fields are reversed, that is,

31*t*>31*b*.

A position 32 indicated by a broken line, at which no deflection is performed in the vertical direction of the quadrupole magnetic field 31 produced by the two trajectory correction coils 22*a*, 22*b*, is vertically shifted in accordance with a vertical deviation from the tube axis of the trajectories of three electron beams 4B, 4G and 4B. With this structure, the degradation in focusing, as illustrated in FIG. 7B, can be suppressed.

The suppression of degradation in focusing can be similarly realized for the phosphor-screen-side trajectory correction means by which the trajectories of electron beams are more deviated from the tube axis.

In this case, it is not necessary that the position, at which no deflection is performed in the vertical direction of the quadrupole magnetic field produced by the trajectory correction coils, should completely correspond to the vertical deviation of the trajectories of three electron beams from the tube axis. It should suffice if the neck-side or phosphor-screen-side trajectory correction means is made to have an action corresponding to the residue of compensation provided by the two trajectory correction means.

Moreover, it is possible to provide auxiliary deflection means synchronized with vertical deviation, at a position of the neck-side trajectory correction means or a position on the cathode side of the electron gun. The auxiliary deflection means performs auxiliary deflection in a direction opposite to the direction of deflection of the deflection yoke at the upper and lower ends of the phosphor screen. Thereby, a vertical displacement itself of the three electron beams 4B, 4G, 4R may be corrected at the position of the neck-side trajectory correction means 14 shown in FIG. 9A.

The above description is directed to the case of the trajectory correction means functioning in synchronism with vertical deflection. The invention, however, is also applicable to the case of the trajectory correction means functioning in synchronism with horizontal deflection. In this case, it should suffice if the position at which no deflection is made in the horizontal direction of the quadrupole magnetic field is horizontally shifted in synchronism with horizontal deflection.

With either means, the degradation of the focusing can be suppressed.

The analysis of degradation of distortion characteristics and a countermeasure to the degradation of distortion characteristics according to another embodiment of the present invention will be described.

Figure 11:
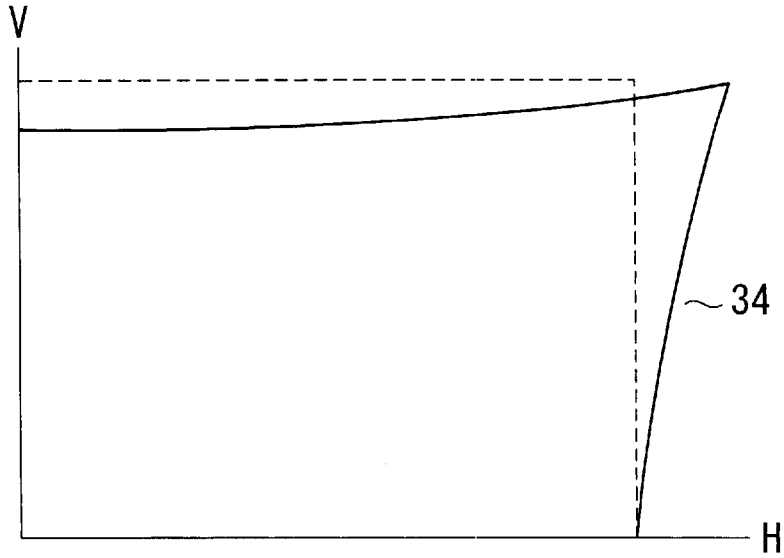
FIG. 11 is a schematic plan view for explaining degradation in distortion characteristics of a color cathode-ray tube apparatus having the trajectory correction means.

FIG. 11 illustrates a variation in distortion in cases where the trajectory correction means 14, 15 shown in FIG. 5 are provided and are not provided. If the trajectory correction means are provided, a raster 34 described on the phosphor screen is distorted as indicated by a solid line, compared to a raster indicated by a broken line which is described when the trajectory correction means are not provided. When the distance q between the phosphor screen and shadow mask increases by $\Delta q = 5$ mm at the vertical axis (V-axis) end of the phosphor screen, relative to the center thereof, a difference of 20 mm occurs in the horizontal direction between the diagonal axis (D-axis) end and the horizontal axis (H-axis) end and a difference of 5 mm occurs in the vertical direction between the diagonal axis (D-axis) end and the vertical axis end.

Figure 6:
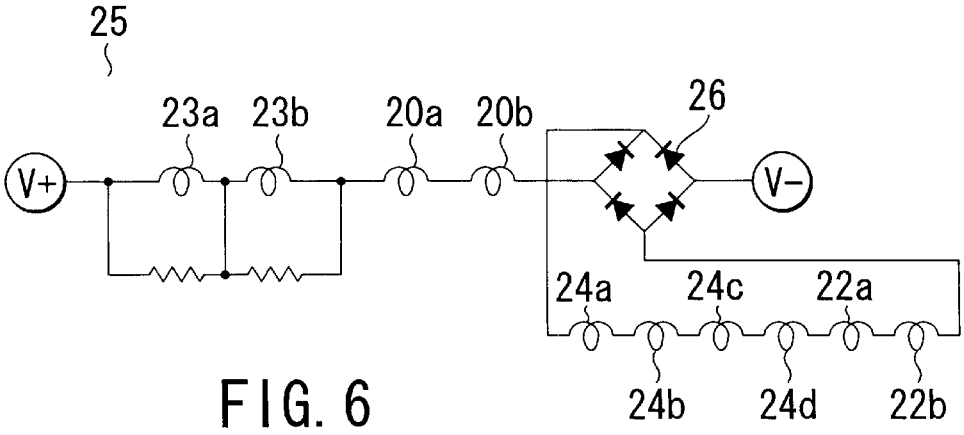
FIG. 6 is a circuit diagram showing a current supply circuit for supplying current to the trajectory correction means shown in FIG. 5.
Figure 12A:
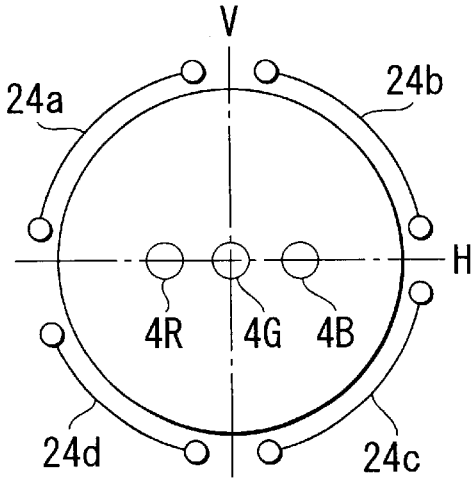
FIGS. 12A to 12D are views for explaining factors of the degradation in distortion characteristics.
Figure 12B:
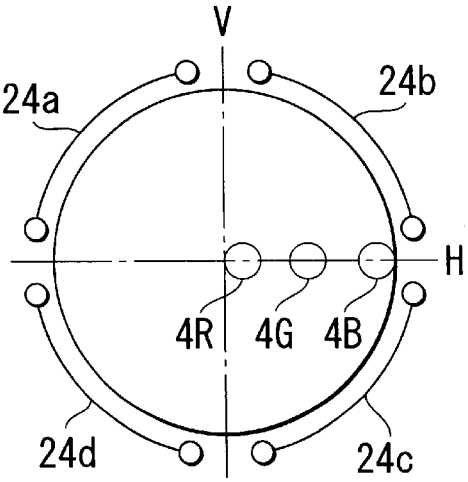
Figure 12C:
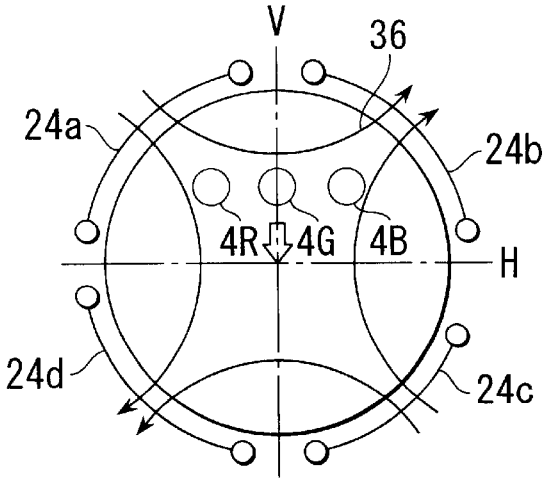
Figure 12D:
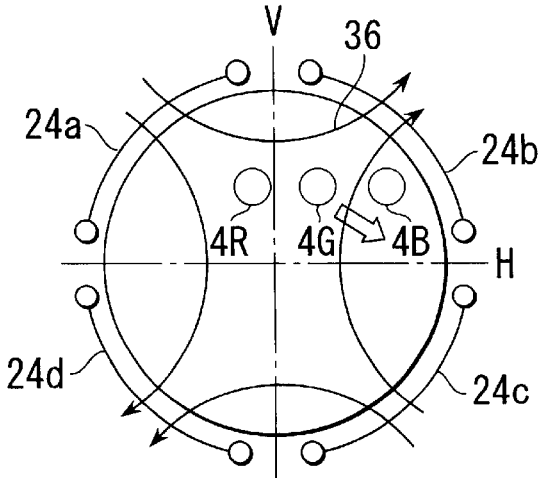

As regards the effect upon the distortion by the two trajectory correction means, the effect by the phosphor-screen-side trajectory correction means is greater than the effect by the neck-side trajectory correction means. Accordingly, the following description is directed to the phosphor-screen-side trajectory correction means.

Where the three electron beams 4B, 4G and 4R are not deflected, as shown in FIG. 12A, no current flows through the four trajectory correction coils 24*a*, 24*b*, 24*c*, 24*d* serving as the phosphor-screen-side trajectory correction means 15, and no quadrupole magnetic field is produced. Where the three electron beams 4B, 4G and 4R are horizontally deflected on the horizontal axis, as shown in FIG. 12B, these beams are horizontally displaced. In this case, too, no current flows through the four trajectory correction coils 24*a*, 24*b*, 24*c*, 24*d* and no quadrupole magnetic field is produced. Accordingly, in these cases, the center beam 4G is not moved by the phosphor-screen-side trajectory correction means 15. However, where deflection toward the upper end of the vertical axis is made, as shown in FIG. 12C, a quadrupole magnetic field 36 produced by the four trajectory correction coils 24*a*, 24*b*, 24*c*, 24*d* exerts a force in a direction of an arrow to prevent vertical deflection. Thus, a slight pincushion distortion occurs at the upper and lower ends, as shown in FIG. 6. Where deflection is made in a diagonal axis direction, as shown in FIG. 12D, the center beam 40, when horizontally displaced, receives a force indicated by the direction of an arrow by the quadrupole magnetic field 36 which the four trajectory correction coils 24*a*, 24*b*, 24*c*, 24*d* produce, so that the horizontal deflection is further increased. As a result, a pincushion type distortion occurs, as shown in FIG. 11.

Figure 13A:
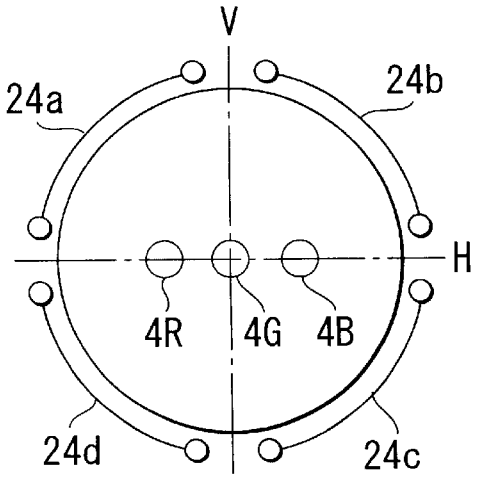
FIGS. 13A to 13D are views for explaining a basic principle of the present invention for solving problems of the degradation in distortion characteristics.
Figure 13B:
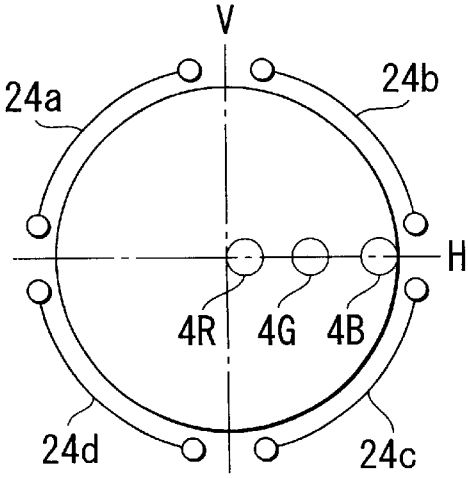
Figure 13C:
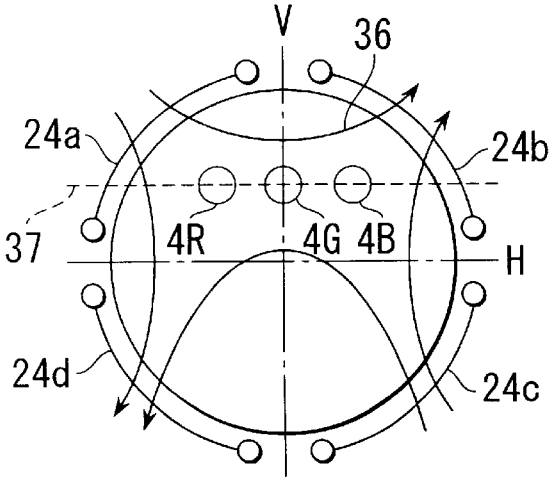
Figure 13D:
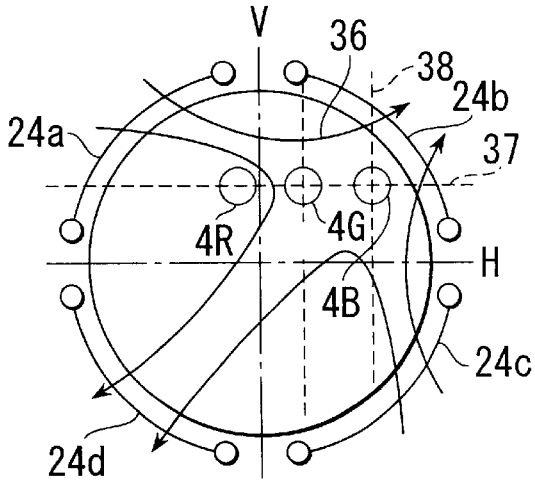
Figure 14A:
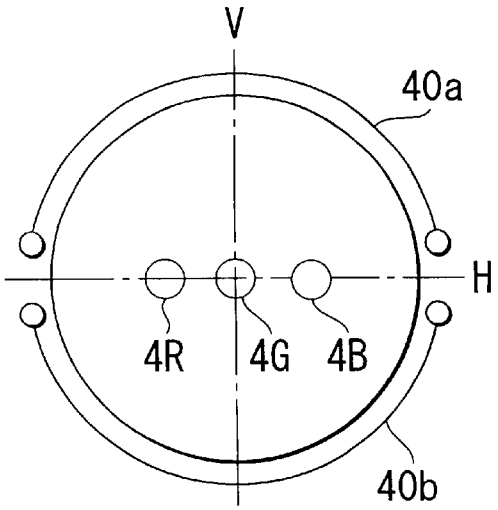
FIGS. 14A to 14D are views for explaining another basic principle of the present invention for solving problems of the degradation in distortion characteristics.
Figure 14B:
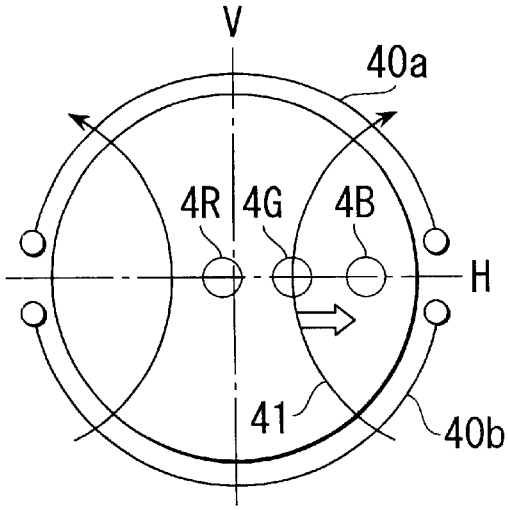
Figure 14C:
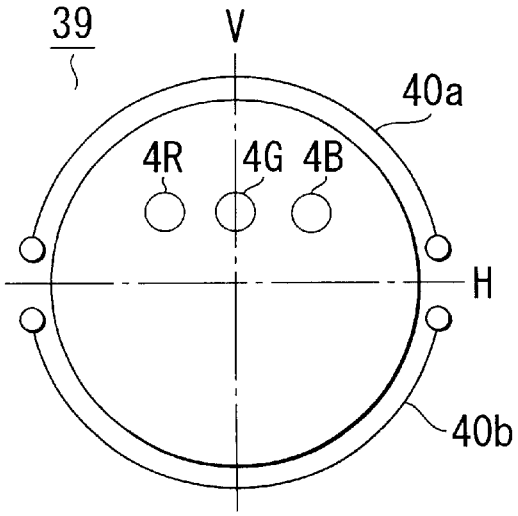
Figure 14D:
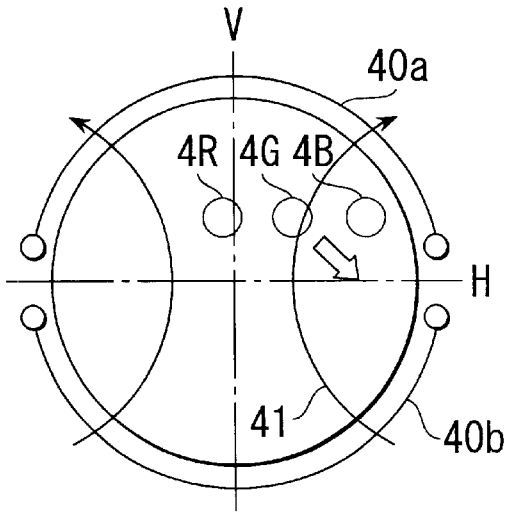
Figure 15A:
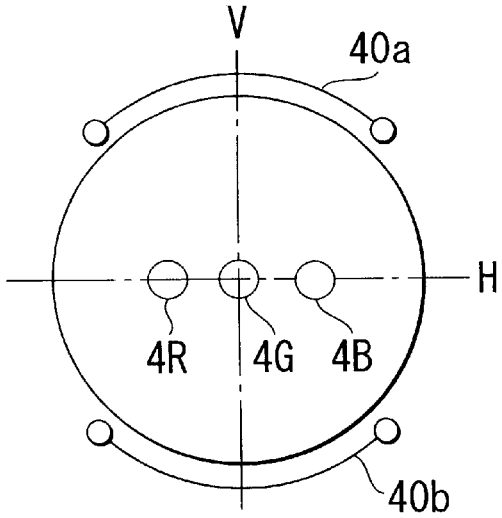
FIGS. 15A to 15D are views for explaining still another basic principle of the present invention for solving problems of the degradation in distortion characteristics.
Figure 15B:
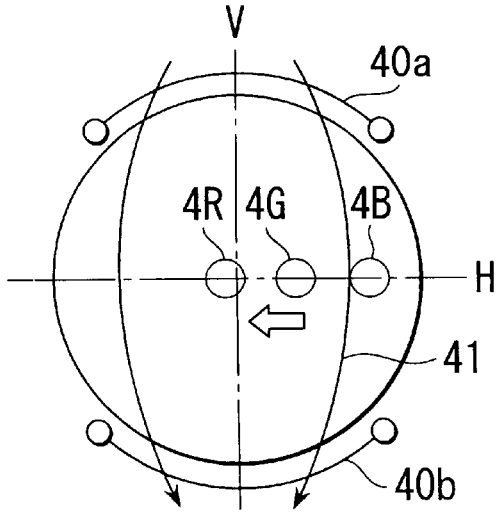
Figure 15C:
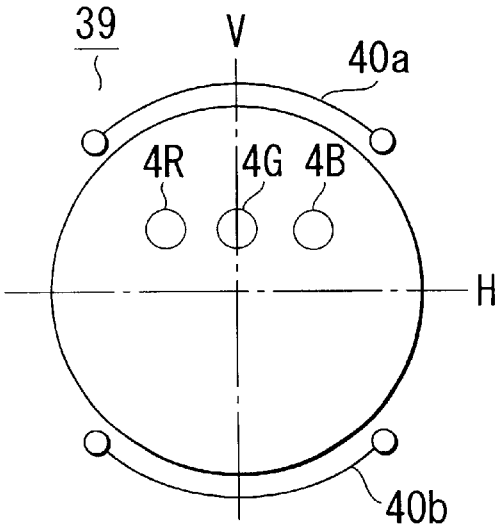
Figure 15D:
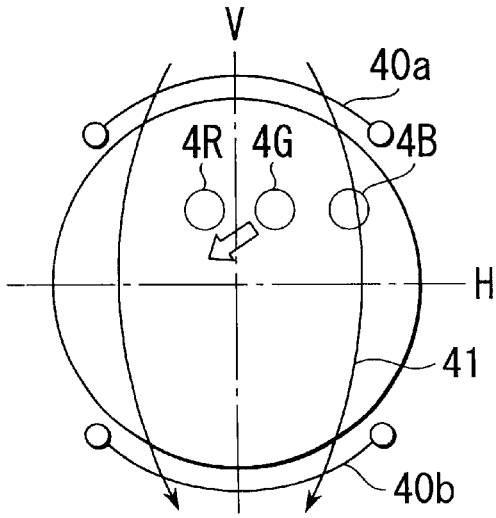

FIGS. 13A to 13D are views for explaining a basic principle according to another embodiment of the present invention for suppressing the degradation in distortion. FIGS. 13A to 13D correspond to FIGS. 12A to 12D.

Where deflection is made toward the upper end of the vertical axis, as shown in FIG. 13A, the intensity balance of the quadrupole magnetic field 36 produced by the four trajectory correction coils 24*a*, 24*b*, 24*c*, 24*d* of the phosphor-screen-side trajectory correction means 15 is adjusted. Thus, the position indicated by a broken line 37, at which the magnetic field 36 is not vertically deflected, is shifted in accordance with vertical displacement of the three electron beams 4B, 4G and 4R. Where deflection is made in the diagonal axis direction, as shown in FIG. 13D, the position indicated by a broken line 38, at which the magnetic field 36 is not horizontally deflected, is shifted in accordance with horizontal displacement of the three electron beams 4B, 4G and 4R. In addition, the position indicated by a broken line 37, at which the magnetic field 36 is not vertically deflected, is shifted in accordance with vertical displacement of the three electron beams 4B, 4G and 4R. Thereby, the effect on the center beam 40 by the phosphor-screen-side trajectory correction means 15 is eliminated over the entire surface of the phosphor screen, and the degradation in distortion characteristics can be suppressed.

The suppression of the degradation of distortion can also be effected by disposing, as shown in FIGS. 14A–14D and 15A–15D, auxiliary deflection coils 40*a*, 40*b* constituting auxiliary deflection means 39 at substantially the same positions as the trajectory correction coils serving as the phosphor-screen-side trajectory correction means. In the auxiliary deflection means, a current varying in a substantially similar manner to a horizontal deflection current is modulated in synchronism with vertical deflection and applied to the auxiliary deflection coils 40*a*, 40*b*.

As regards the auxiliary deflection means 39 shown in FIGS. 14A to 14D, a magnetic field 41 produced by the auxiliary deflection coils 40*a*, 40*b* is of a pincushion type which increases horizontal deflection. As the degree of vertical deflection increases, the magnitude of supply current decreases. With this structure, a pincushion distortion at the right and left ends as shown in FIG. 11 is corrected by a difference in modulated current between the diagonal axis end and horizontal axis end. With the inclination of the line of magnetic force of the pincushion magnetic field at the diagonal axis end, the pincushion distortion at the upper and lower ends as shown in FIG. 11 is corrected.

In the case of the auxiliary deflection means 39 shown in FIGS. 15A to 15D, the magnetic field 41 produced by the auxiliary deflection coils 40*a*, 40*b* is of a barrel type which suppresses horizontal deflection. As the degree of vertical deflection increases, the magnitude of supply current increases. With this structure, a pincushion distortion at the right and left ends as shown in FIG. 11 is corrected by a difference in modulated current between the diagonal axis end and horizontal axis end with the inclination of the line of magnetic force of the barrel-type magnetic field at the diagonal axis end, the pincushion distortion at the upper and lower ends as shown in FIG. 11 is corrected.

The suppression of the degradation in distortion can also be realized by providing the auxiliary deflection means at the position of the neck-side trajectory correction means.

The suppression of the degradation in distortion is realized not only by the trajectory correction means functioning in synchronism with vertical deflection, but also by the trajectory correction means functioning in synchronism with horizontal deflection. In this case, the current to be supplied to the auxiliary deflection means is modulated in synchronism with horizontal deflection, and the trajectory correction means is basically constructed to produce an auxiliary deflection magnetic field to effect vertical auxiliary deflection.

The above description has been directed to the two trajectory correction means provided on the color cathode-ray tube apparatus which realizes the flat screen by using the press-formed shadow mask. The present invention, however, is not limited to the color cathode-ray tube apparatus which realizes the flat screen. This invention is also applicable to cases where at least one trajectory correction means is provided and a degradation occurs in focusing or distortion due to the displacement between the trajectory correction magnetic field and trajectories of electron beams.

Embodiments of the invention will be described below.

First Embodiment 1

Figure 16:
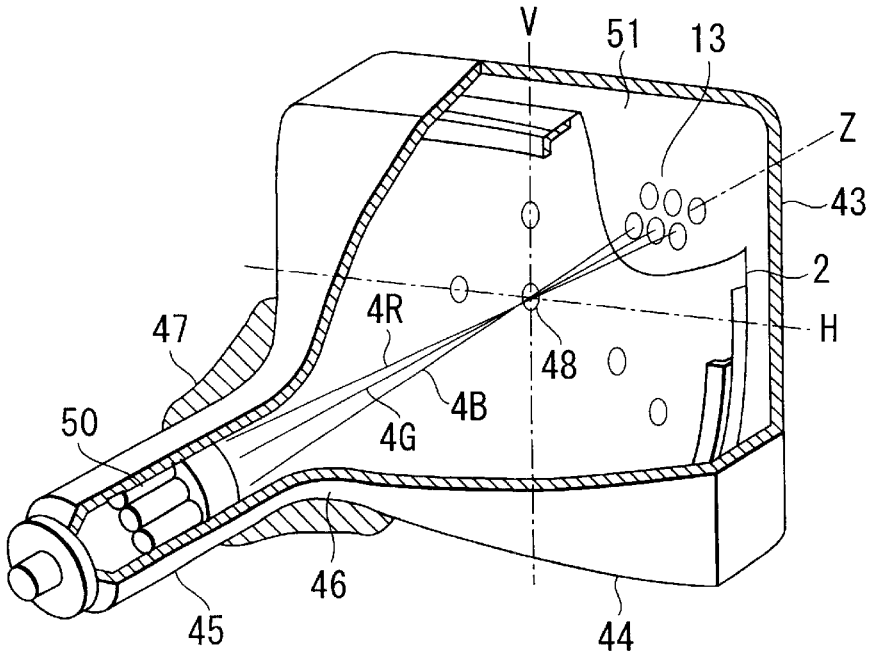
FIG. 16 is a broken perspective view schematically showing the structure of a color cathode-ray tube apparatus according to an embodiment of the present invention.

FIG. 16 shows a structure of a color cathode-ray tube apparatus wherein degradation in focusing characteristics is suppressed. The color cathode-ray tube apparatus has a vacuum envelope comprising a substantially rectangular panel 43, a funnel formed to be continuous with the panel 43, and a cylindrical neck 45 formed to be continuous with a small-diameter end portion of the funnel 44. A deflection yoke 47 is mounted on a region extending from a funnel (44) side portion of the neck 45 to a small-diameter portion 46 of the funnel 44. An inner face of the panel 43 is provided with a phosphor screen 13 having dot-like three-color phosphor layers which emit blue, green and red. A shadow mask 2 (color selection mask) is disposed to be opposed to the phosphor screen 13, at a distance from the phosphor screen 13. That surface of the shadow mask 2, which is opposed to the phosphor screen 13, has a great number of electron beam passage holes 48 arranged with a predetermined pitch. The neck 45 includes an electron gun apparatus 50 for emitting three in-line electron beams 4B, 4G and 4R comprising a center beam 40 and a pair of side beams 4B and 4R which travel in the same horizontal plane. The electron beams 4B, 4G and 4R emitted from the electron gun apparatus 50 are deflected by horizontal and vertical deflection magnetic fields produced by horizontal and vertical deflection coils of the deflection yoke 47. The electron beams are made to horizontally and vertically scan the phosphor screen 13 through the shadow mask 2. Thus, a color image is displayed.

In particular, in this color cathode-ray tube apparatus, the panel 43 has a display section 51 with a flat outer surface and a curved inner surface of a slight curvature. That surface of the shadow mask 2, which is opposed to the phosphor screen 13, is curved with a curvature greater than that of the inner surface of the display section 51 of the panel 43. For example, in the panel 43, the effective diagonal dimension of the phosphor screen 13 is about 460 mm, and the fall in the tube axis direction of the diagonal axis end is about 10 mm relative to the center of the inner surface of the display section 51. On the other hand, as regards the shadow mask 2, the fall in the tube axis direction of the diagonal axis end is about 16 mm relative to the center of the opposed surface. Thus, the opposed surface of the shadow mask 2 has a greater curvature than the inner surface of the display section 51 of panel 43. The deflection yoke 47 is provided with two trajectory correction means for preventing degradation in landing characteristics due to a difference in curvature between the inner surface of the display section 51 of panel 43 and the opposed surface of shadow mask 2.

Figure 17:
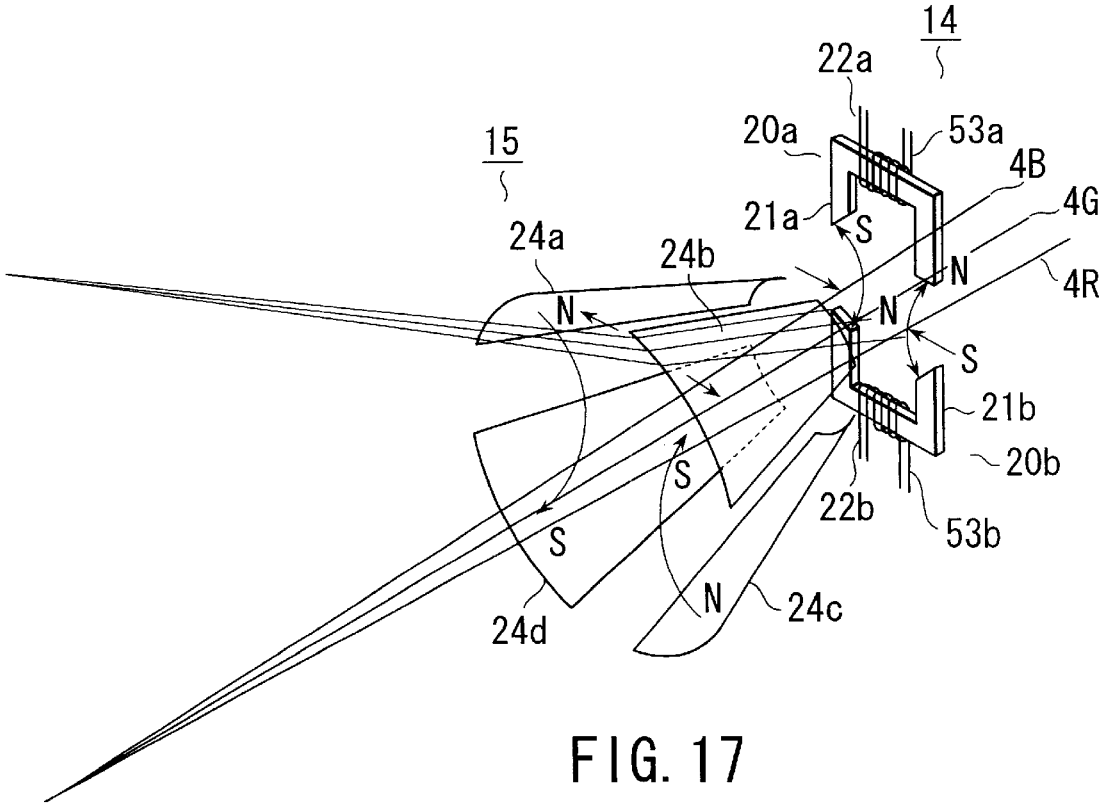
FIG. 17 is a perspective view schematically showing the structure of trajectory correction means provided in the color cathode-ray tube apparatus shown in FIG. 16.

The trajectory correction means, as shown in FIG. 17, comprise two pairs of trajectory correction coils 22*a*, 22*b*, 53*a*, 53*b* serving as neck-side trajectory correction means 14, which are wound in pairs around two U-shaped magnetic cores 21*a*, 21*b* of coma-free coils 20*a*, 20*b* provided on the neck-side portion of the deflection yoke 47; four trajectory correction coils 24*a*, 24*b*, 24*c*, 24*d* serving as phosphor-screen-side trajectory correction means 15, which are wound around bobbins (not shown) supporting vertical deflection coils; and a current supply circuit for supplying current to the trajectory correction coils 22*a*, 22*b*, 53*a*, 53*b*, 24*a*, 24*b*, 24*c*, 24*d*.

Figure 18:
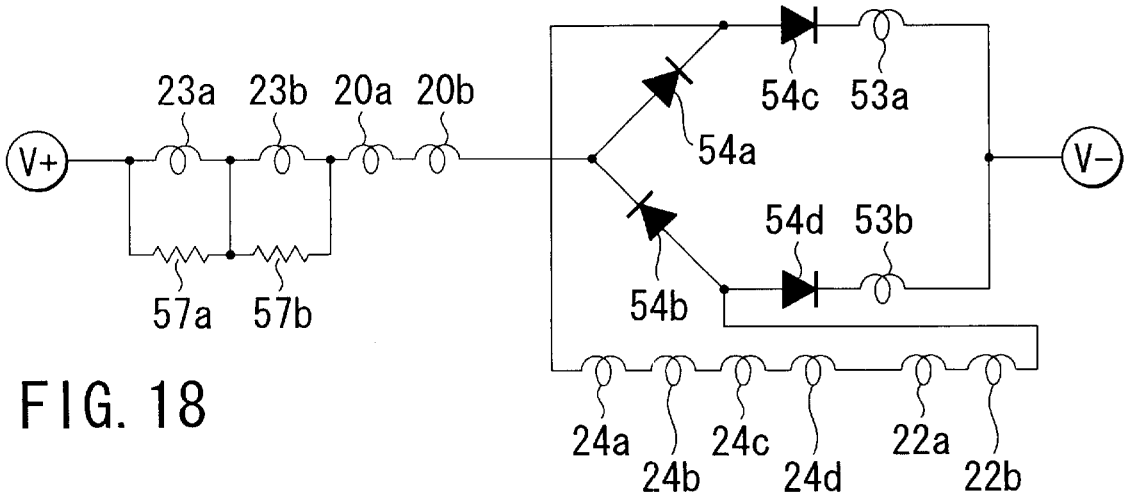
FIG. 18 is a circuit diagram showing a current supply circuit for supplying current to the trajectory correction means provided in the color cathode-ray tube apparatus shown in FIG. 16.
Figure 19A:
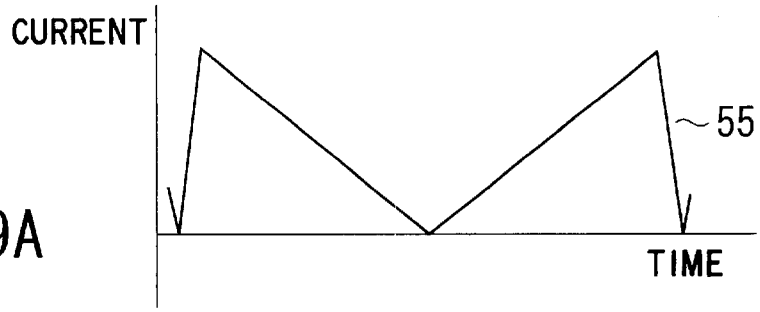
FIGS. 19A to 19C are waveform diagrams showing waveforms of current supplied to the trajectory correction means provided in the color cathode-ray tube apparatus shown in FIG. 16.
Figure 19B:
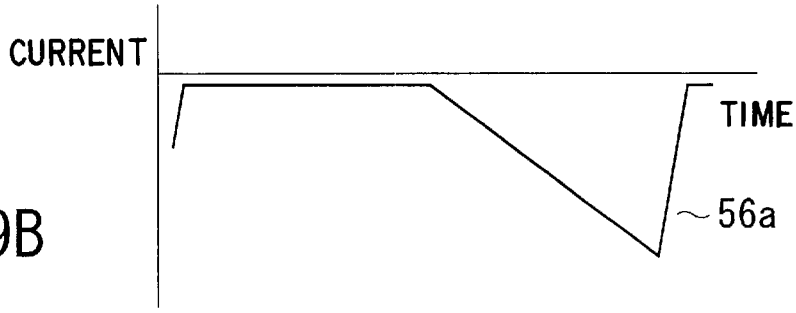
Figure 19C:
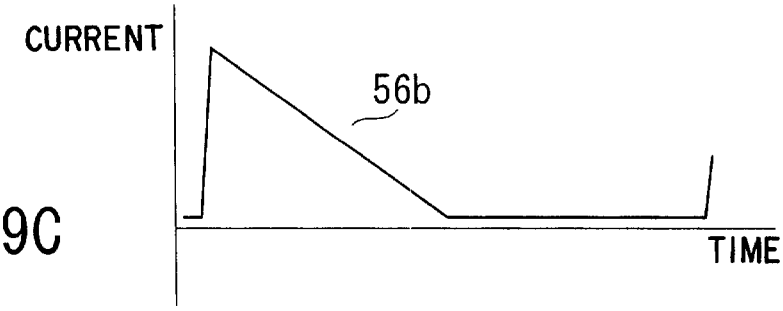

The current supply circuit is constructed as shown in FIG. 18. Diodes 54*a*, 54*b*, 54*c*, 54*d* are connected to the vertical deflection coils 23*a*, 23*b* via the comafree coils 20*a*, 20*b*. A substantially parabolic current 55, as shown in FIG. 19A, which is rectified by the diodes 54*a*, 54*b*, 54*c*, 54*d*, is supplied to the trajectory correction coils 22*a*, 22*b*, 24*a*, 24*b*, 24*c*, 24*d*. Currents 56*a*, 56*b*, as shown in FIGS. 19B and 19C, are supplied to the trajectory correction coils 53*a*, 53*b* via the diodes 54*c*, 54*d*, only when upward and downward deflection is made on the phosphor screen. Numerals 57*a*, 57*b* in FIG. 18 denote damping resistors for bypassing high-frequency current applied to the vertical deflection coils 23*a*, 23*b*.

With the currents 55, 56*a*, 56*b* being supplied, the neck-side trajectory correction means 14 over-converges the paired side beams, and the phosphor-screen-side trajectory correction means 15 under-converges them. Thus, a optimal q value is increased by about 5 mm.

Moreover, as regards the trajectory correction coils 53*a*, 53*b* of the neck-side trajectory correction means 14, only the lower-side trajectory correction coil 53*b* generates a magnetic field 58, as shown in FIG. 20A, when the three electron beams 4B, 4G, 4R are deflected upward on the phosphor screen. When the three electron beams 4B, 4G, 4R are deflected downward on the phosphor screen, only the upper-side trajectory correction coil 53*a* generates a magnetic field 58. Thereby, the trajectory correction coils 22*a*, 22*b*, 53*a*, 53*b*, as a whole, produce the same magnetic field as the magnetic field 31 shown in FIGS. 10A and 10B. Accordingly, with the above structure, the degradation in focusing characteristics can be suppressed.

Second Embodiment

A color cathode-ray tube apparatus wherein degradation in distortion characteristics is suppressed will now be described.

The structure of this color cathode-ray tube apparatus is basically the same as that of the color cathode-ray tube apparatus shown in FIG. 16. Auxiliary deflection means 39 as shown in FIG. 21A is additionally provided.

The auxiliary deflection means 39, as shown in FIG. 21B, comprises two auxiliary deflection coils 40*a*, 40*b* wound around bobbins (not shown) of horizontal deflection coils, and a current supply circuit for supplying current to the auxiliary deflection coils 40*a*, 40*b*.

As is shown in FIG. 21B, the current supply circuit has an inductance element 63 comprising inductance coils 61*a*, 61*b* and a saturation control coil 62 wound around a saturable core 60. The inductance coils 61*a*, 61*b* are connected to horizontal deflection coils 64*a*, 64*b* in parallel with the auxiliary deflection coils 40*a*, 40*b*. A vertical deflection current is supplied to the saturation control coil 62.

Accordingly, the load on the inductance coils 61*a*, 61*b* decreases at the time of vertical deflection, and the horizontal deflection current flowing in the auxiliary deflection coils 40*a*, 40*b* decreases. Thus, the suppression of degradation in distortion characteristics, as shown in FIGS. 14A to 14D, is realized.

Third Embodiment

A color cathode-ray tube apparatus wherein degradation in focusing characteristics is suppressed by means different from the means in Embodiment 1 will now be described.

Figure 22A:
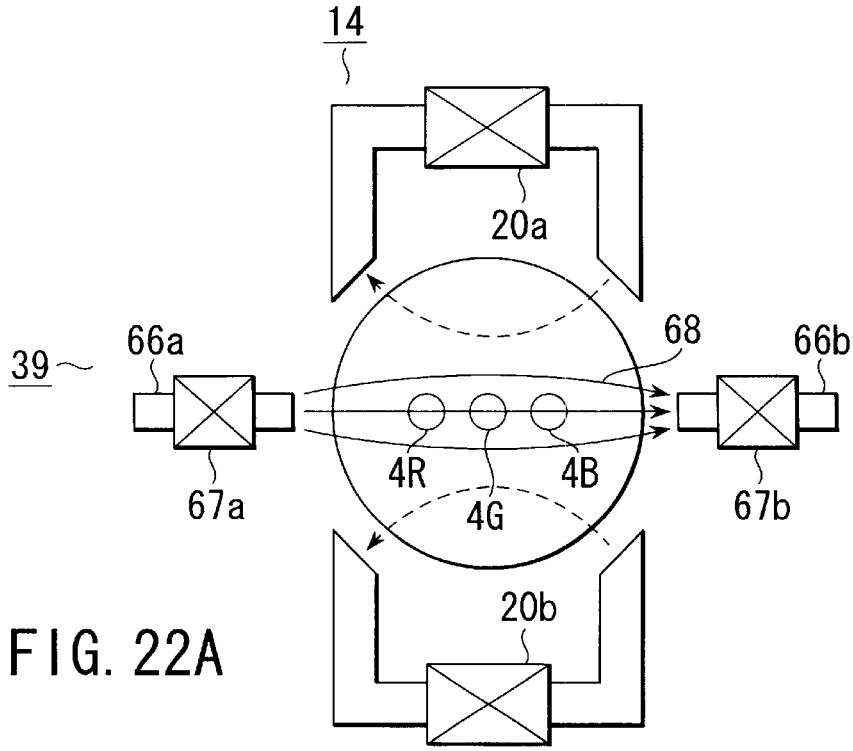
FIG. 22A is a front view for schematically showing the structures of auxiliary deflection coils provided in a color cathode-ray tube apparatus according to a third embodiment of the present invention.

In this color cathode-ray tube apparatus, the neck-side trajectory correction means, i.e. one of the two trajectory correction means, is constructed as shown in FIG. 22A. Auxiliary deflection means 39 shown in FIGS. 22A and 22B is added to this trajectory correction means.

The auxiliary deflection means 39, as shown in FIG. 22A, comprises two auxiliary deflection coils 67*a*, 67*b* and a current supply circuit for supplying current to the auxiliary deflection coils 67*a*, 67*b*. the auxiliary deflection coils 67*a*, 67*b* are wound around rod-like magnetic cores 66*a*, 66*b* and disposed on both sides in the direction of arrangement of three electron beams on the same tube axis as the coma-free coils 20*a*, 20*b*.

Figure 22B:
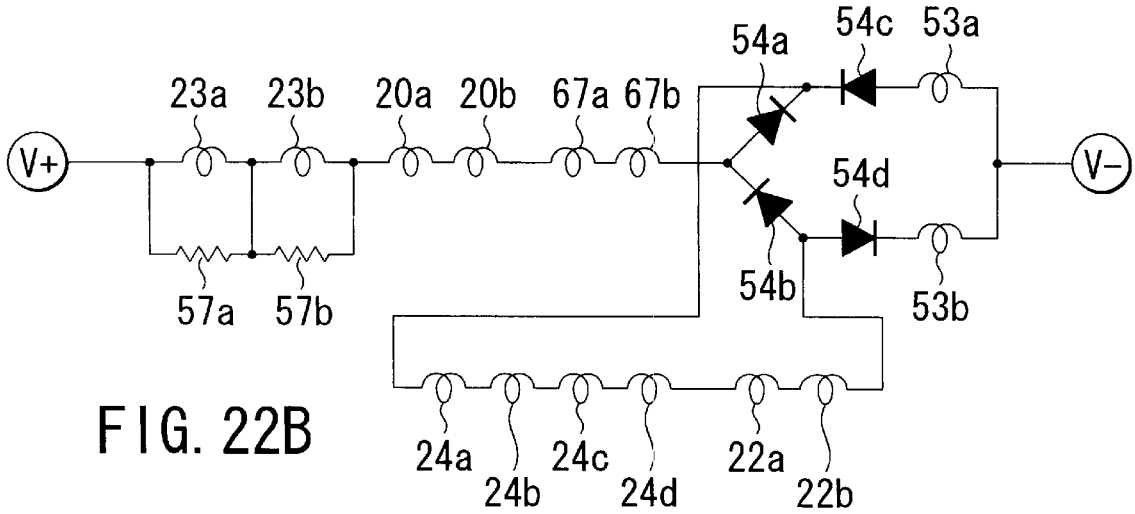
FIG. 22B is a circuit diagram showing a current supply circuit for supplying current to the auxiliary deflection coils shown in FIG. 22A.

As is shown in FIG. 22B, the current supply circuit is constructed such that the auxiliary deflection coils 67*a*, 67*b* are interposed between the coma-free coils 20*a*, 20*b* and diodes 54*a*, 54*b* in the current supply circuit shown in FIG. 18.

With this structure, vertical deflection current is supplied to the auxiliary deflection coils 67*a*, 67*b*, and magnetic poles are created at both sides in the direction of arrangement of three electron beams. Thus, a dipolar magnetic field 68 which suppresses vertical deflection is produced. Accordingly, the intensity of the magnetic field 68 produced by the auxiliary deflection coils 67*a*, 67*b* is properly controlled, and a vertical displacement of three electron beams 4B, 4G, 4R is corrected by the neck-side trajectory correction means. Therefore, degradation in focusing characteristics can be suppressed.

With the above-described structure, there is provided a color cathode-ray tube apparatus in which no degradation occurs in focusing or distortion characteristics, even where electron beam trajectory correction means with a high degree of magnetic field distribution displacement is provided, for example, in realizing a flat screen by using a press-formed shadow mask.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode-ray tube apparatus comprising:

a vacuum envelope composed of a substantially rectangular panel, a funnel formed to be continuous with the panel and having a small-diameter end portion, and a neck formed to be continuous with the small-diameter end portion of the funnel;

a phosphor screen having phosphor layers provided on an inner surface of the panel;

a shadow mask having a surface opposed to the phosphor screen at a distance from the phosphor screen, the surface having a great number of electron beam passage holes;

an electron gun apparatus provided within the neck and having a cathode and a plurality of electrodes for emitting three in-line electron beams consisting of a center beam and a pair of side beams traveling in the same plane;

a deflection yoke mounted on a region extending from a funnel-side portion of the neck to a small-diameter portion of the funnel, the deflection yoke deflecting the three electron beams in a first direction, which is a direction of arrangement of the three electron beams, and in a second direction perpendicular to the first direction; and trajectory correction means for correcting trajectories of the side beams, the trajectory correction means including a plurality of trajectory correction coils disposed between the cathode of the electron gun apparatus and the phosphor screen and a current supply circuit for supplying to the trajectory correction coils a current synchronized with deflection of at least one of said first direction and said second direction, at least one of the trajectory correction means functioning to relatively over-converge or under-converge the pair of side beams at a peripheral portion of the phosphor screen relative to a center of the phosphor screen, there is a position in a magnetic field produced in a region of passage of the three electron beams, where no force is exerted on the three electron beams in the one direction of the first and second directions, and a magnetic field being produced to separate this position from a plane including a tube axis, the other direction of the first and second directions.

2. A color cathode-ray tube apparatus comprising:

a vacuum envelope composed of a substantially rectangular panel, a funnel formed to be continuous with the panel and having a small-diameter end portion, and a neck formed to be continuous with the small-diameter end portion of the funnel;

a phosphor screen provided on an inner surface of the panel;

a shadow mask having a surface opposed to the phosphor screen at a distance from the phosphor screen, the surface having a great number of electron beam passage holes;

an electron gun apparatus provided within the neck and having a cathode and a plurality of electrodes for emitting three in-line electron beams consisting of a center beam and a pair of side beams traveling in the same plane;

a deflection yoke mounted on a region extending from a funnel-side portion of the neck to a small-diameter portion of the funnel, the deflection yoke deflecting the three electron beams in a first direction, which is a direction of arrangement of the three electron beams, and in a second direction perpendicular to the first direction;

trajectory correction means for correcting trajectories of the side beams, the trajectory correction means including a plurality of trajectory correction coils disposed between the cathode of the electron gun apparatus and the phosphor screen and a current supply circuit for supplying to the trajectory correction coils a current synchronized with deflection of said first direction or said second direction, the trajectory correction means functioning to relatively over-converge or under-converge the side beams at a peripheral portion of the phosphor screen relative to a center of the phosphor screen; and at least one auxiliary deflection means comprising a plurality of auxiliary deflection coils disposed between the cathode of the electron gun apparatus and the phosphor screen and a current supply circuit for supplying to the auxiliary deflection coils a current synchronized with deflection of at least one of said first and second directions, said auxiliary deflection means effecting auxiliary deflection for the three electron beams at the peripheral portion of the phosphor screen in a direction opposite to the direction of deflection of the deflection yoke.

3. A color cathode-ray tube apparatus comprising:

a vacuum envelope composed of a substantially rectangular panel, a funnel formed to be continuous with the panel and having a small-diameter end portion, and a neck formed to be continuous with the small-diameter end portion of the funnel;

a phosphor screen provided on an inner surface of the panel;

a shadow mask having a surface opposed to the phosphor screen at a distance from the phosphor screen, the surface having a great number of electron beam passage holes;

an electron gun apparatus provided within the neck and having a cathode and a plurality of electrodes for emitting three in-line electron beams consisting of a center beam and a pair of side beams traveling in the same plane;

a deflection yoke mounted on a region extending from a funnel-side portion of the neck to a small-diameter portion of the funnel, the deflection yoke deflecting the three electron beams in a first direction, which is a direction of arrangement of the three electron beams, and in a second direction perpendicular to the first direction;

at least one trajectory correction means including a plurality of trajectory correction coils disposed between the cathode of the electron gun and the phosphor screen and a current supply circuit for supplying to the trajectory correction coils a current synchronized with deflection of at least said second direction, the trajectory correction means functioning to relatively over-converge or under-converge the pair of side beams at a peripheral portion of the phosphor screen relative to a center of the phosphor screen; and auxiliary deflection means comprising a plurality of auxiliary deflection coils disposed between the cathode of the electron gun and the phosphor screen and a current supply circuit for supplying to the auxiliary deflection coils a current synchronized with deflection of said first direction and synchronized with deflection of said second direction and modulated, said auxiliary deflection means effecting auxiliary deflection for the three electron beams at the peripheral portion of the phosphor screen in the first direction.

4. A color cathode-ray tube apparatus comprising:

a vacuum envelope composed of a substantially rectangular panel, a funnel formed to be continuous with the panel and having a small-diameter end portion, and a neck formed to be continuous with the small-diameter end portion of the funnel;

a phosphor screen provided on an inner surface of the panel;

a shadow mask having a surface opposed to the phosphor screen at a distance from the phosphor screen, the surface having a great number of electron beam passage holes;

an electron gun apparatus provided within the neck and having a cathode and a plurality of electrodes for emitting three in-line electron beams consisting of a center beam and a pair of side beams traveling in the same plane;

a deflection yoke mounted on a region extending from a funnel-side portion of the neck to a small-diameter portion of the funnel, the deflection yoke deflecting the three electron beams in a first direction, which is a direction of arrangement of the three electron beams, and in a second direction perpendicular to the first direction;

at least one trajectory correction means including a plurality of trajectory correction coils disposed between the cathode of the electron gun and the phosphor screen and a current supply circuit for supplying to the trajectory correction coils a current synchronized with deflection of at least said first direction, the trajectory correction means functioning to relatively over-converge or under-converge the pair of side beams at a peripheral portion of the phosphor screen relative to a center of the phosphor screen; and auxiliary deflection means comprising a plurality of auxiliary deflection coils disposed between the cathode of the electron gun and the phosphor screen and a current supply circuit for supplying to the auxiliary deflection coils a current synchronized with deflection of said second direction and synchronized with deflection of said first direction and modulated, said auxiliary deflection means effecting auxiliary deflection for the three electron beams at the peripheral portion of the phosphor screen in the second direction.

* * * * *